US007185506B2

(12) United States Patent
Aflekt et al.

(10) Patent No.: US 7,185,506 B2
(45) Date of Patent: Mar. 6, 2007

(54) REVERSIBLE VAPOR COMPRESSION SYSTEM

(75) Inventors: Kåre Aflekt, Trondheim (NO); Einar Brendeng, Trondheim (NO); Armin Hafner, Trondheim (NO); Petter Nekså, Trondheim (NO); Jostein Pettersen, Ranheim (NO); Håvard Rekstad, Trondheim (NO); Geir Skaugen, Trondheim (NO); Gholam Reza Zakeri, Trondheim (NO)

(73) Assignee: Sinvent AS, Trondheim (NO)

( * ) Notice: Subject to any disclaimer, the term of this patent is extended or adjusted under 35 U.S.C. 154(b) by 139 days.

(21) Appl. No.: 10/362,912

(22) PCT Filed: Aug. 31, 2001

(86) PCT No.: PCT/NO01/00355

§ 371 (c)(1),
(2), (4) Date: Aug. 18, 2003

(87) PCT Pub. No.: WO02/18848

PCT Pub. Date: Mar. 7, 2002

(65) Prior Publication Data

US 2004/0025526 A1 Feb. 12, 2004

(30) Foreign Application Priority Data

Sep. 1, 2000 (NO) ..... 20004369
Nov. 3, 2000 (NO) ..... 20005576

(51) Int. Cl.
*F25B 13/00* (2006.01)
*F25B 41/00* (2006.01)

(52) U.S. Cl. ..... 62/324.6; 62/324.1; 62/513

(58) Field of Classification Search ..... 62/324.1, 62/324.2, 324.6, 115, 160; 165/97, 101
See application file for complete search history.

(56) References Cited

U.S. PATENT DOCUMENTS

RE30,433 E 11/1980 Bussjager
4,240,269 A 12/1980 Bussjager
RE30,745 E 9/1981 Chambless (Continued)

FOREIGN PATENT DOCUMENTS

DE 19939028 3/2000

(Continued)

*Primary Examiner*—Chen Wen Jiang
(74) *Attorney, Agent, or Firm*—Wenderoth, Lind & Ponack, L.L.P.

(57) ABSTRACT

Reversible vapor compression system including a compressor (1), an interior heat exchanger (2), an expansion device (6) and an exterior heat exchanger (3) connected by means of conduits in an operable relationship to form an integral main circuit. A first device is provided in the main circuit between the compressor and the interior heat exchanger, and a second device is provided on the opposite side of the main circuit between the interior and exterior heat exchangers to enable reversing of the system from cooling mode to heating mode and vice versa. The first and second device for reversing of the system include a first and second sub-circuit (A respectively B) each of which is connected with the main circuit through a flow reversing device (4 and 5 respectively). Included in the system solution is a reversible heat exchanger for refrigerant fluid, particularly carbon dioxide. It includes a number of interconnected sections arranged with air flow sequentially through the sections. The first and last sections are inter-connected whereby the refrigerant fluid flow in the heat exchanger can be changed from heating to cooling mode by means of flow changing devices provided between the respective sections.

28 Claims, 31 Drawing Sheets

U.S. PATENT DOCUMENTS

| | | | | | |
|---|---|---|---|---|---|
| 4,430,864 | A | * | 2/1984 | Mathiprakasam | 62/94 |
| 4,939,910 | A | * | 7/1990 | Umezu et al. | 62/160 |
| 4,962,647 | A | | 10/1990 | Kuwahara | |
| 5,065,586 | A | * | 11/1991 | Shapiro-Baruch | 62/93 |
| 5,473,906 | A | | 12/1995 | Hara et al. | |
| 5,996,368 | A | | 12/1999 | Kim | |
| 6,000,235 | A | | 12/1999 | Kuhlenschmidt | |

FOREIGN PATENT DOCUMENTS

| | | |
|---|---|---|
| GB | 2143017 | 1/1985 |
| GB | 2194320 | 3/1988 |
| JP | 54-146052 | 11/1979 |
| JP | 4-340063 | 11/1992 |
| WO | 9744625 | 11/1997 |

* cited by examiner

REVERSIBLE VAPOR COMPRESSION SYSTEM

BACKGROUND OF THE INVENTION

1. Field of the Invention

The present invention relates to vapor compression systems such as refrigeration, air-conditioning, heat pump systems and/or a combination of these, operating under transcritical or sub-critical conditions using any refrigerant and in particular carbon dioxide, and more specifically but not limited to an apparatus operating as a reversible refrigeration/heat pump system.

2. Description of Prior Art

A non-reversible vapor compression system in its basic form is composed of one main circuit which provides a compressor 1, a heat rejecter 2, a heat absorber 3 and an expansion device 6 as shown in FIG. 1. The said system can function either in heating or cooling mode. To make the system reversible, i.e. to enable it to work as both heat pump and refrigeration system, known prior arts use different system design changes and addition of new components to the said circuit to achieve this goal. The known prior arts and their disadvantages are now described.

The most commonly used system comprises a compressor, a flow reversing valve, an interior heat exchanger, an internal heat exchanger, two throttling valves, two check valves, exterior heat exchanger and a low-pressure receiver/accumulator, see FIG. 2. The reversing is carried out using the flow reversing valve, two check valves and two throttling valves. The disadvantage of this solution is that it uses two throttling valves and the fact that the internal heat exchanger will be in parallel flow in either heating or cooling mode, which is not favorable. In addition, the solution is little flexible and can not be effectively used with systems using an intermediate-pressure receiver.

EP 0604417 B1 and WO90/07683 disclose a transcritical vapor compression cycle device and methods for regulating its supercritical high-side pressure. The disclosed system includes a compressor, gas cooler (condenser) a counter-flow internal heat exchanger, an evaporator and a receiver/accumulator. High-pressure control is achieved by varying the refrigerant inventory of the receiver/accumulator. A throttling device between the high-pressure outlet of the counter-flow internal heat exchanger and evaporator inlet is applied as steering means. This solution can be used either in heat pump or refrigeration mode.

Additionally DE19806654, describes a reversible heat pump system for motor vehicles powered by an internal combustion engine where the engine coolant system is used as heat source. The disclosed system uses an intermediate pressure receiver with bottom-feed flashing of high pressure refrigerant in heat pump operation mode that is not ideal.

Further, DE19813674C1 discloses a reversible heat pump system for automotive air conditioning where exhaust gas from the engine is used as heat source. The disadvantage of this system is the possibility of oil decomposition in the exhaust gas heat recovery heat exchanger (when not in use) as the temperature of the exhaust gas is relatively high.

Still further, U.S. Pat. No. 5,890,370 discloses a single-stage reversible transcritical vapor compression system using one reversing device and a special made reversible throttling valve that can operate in both flow directions. The main disadvantage of the system is the complex control strategy that is required by the special made throttling valve. In addition, in its present status, it can only be applied to single stage systems.

Yet another patent, U.S. Pat. No. 5,473,906, disclosed an air conditioner for vehicle where the system uses two or more reversing devices for reversing system operation from heating to cooling mode. In addition, the patented system has two interior heat exchangers. Compared to the present invention, in one of the proposed embodiment of the said patent, the arrangement is such that the interior heat exchanger is placed between the throttling valve and the second reversing device. The main disadvantage of this arrangement is that the low-pressure vapor from the outlet of the interior heat exchanger has to pass through the second reversing device which results in extra pressure drop for the low-pressure refrigerant (suction gas) in cooling mode. In heating mode, the system suffers also from a higher pressure drop on the heat rejection side of the system as the discharge gas has to pass through two reversing devices before it is cooled down. In another embodiment from the said patent, the same interior is placed between the first reversing device and the compressor. This embodiment again results in a higher pressure drop on the heat rejection side in heating mode operation. In yet another embodiment, the compressor is in direct communication with said two four way valves. Again this embodiment results in extra pressure drop for the low-pressure refrigerant (suction gas) in cooling mode as the said suction gas has to pass through the said two four way valves before entering the compressor. In heating mode, it also suffers from a higher pressure drop. In addition, the placement of the receiver after the condenser in the proposed embodiments is such that it can only be used for conventional system with condenser and evaporator heat exchanger and as such it is not suitable for transcritical operation since the devised pressure receiver does not have any function in transcritical operation. Another general drawback of the system is that the patent does not provide embodiments for other application such as simple unitary system, two-staged compression, combined water heating and cooling as the present invention does since the said patent was intended exclusively for vehicle air conditioning.

Regarding the second aspect of the present invention, US-Re030433 refers to condenser and evaporator operation of the heat exchanger, while the present application is concerned with evaporator and gas cooler operation. In the latter case, refrigerant is a single-phase fluid, and condenser draining is not an issue. In a gas cooler, the purpose is often to heat the air flow over a range of temperature, and this cannot be done if the sections of the heat exchanger operate in parallel on the air side. Thus, in gas coolers, the design of the circuit will be different than in a heat exchanger that needs to serve as a condenser. In the present application, air always flows sequentially through the sections of the heat exchanger, while in the US-Re030433 invention, air flows through all "heat transfer zones" in parallel.

Another patent, US-Re030745 discloses a reversible heat exchanger which has many similarities to the one above (US-Re030433), including the fact that operation is limited to evaporator and condenser modes. Also in this case, the air flows in parallel through all sections. Another important difference is that the patent describes a heat exchanger where all sections are connected in parallel on the refrigerant side during evaporator operation. In the present application, the refrigerant usually flows sequentially through the heat exchanger also in evaporator mode.

In essence, the present application describes a reversible heat exchanger that serves as a heater in one mode—by cooling supercritially pressurized refrigerant and heating air—while it operates as an evaporator in another mode, in both cases the refrigerant and the air flows sequentially through the sections. The only difference is that in gas cooler operation refrigerant flows sequentially through all sections in counterflow with the air, while in evaporator operation, two and two sections are connected in parallel.

These aspects are not covered by these two said patents, and neither of the above patents would serve the desired purposes in gas cooler operation.

SUMMARY OF THE INVENTION

The present invention solves the disadvantages of the aforementioned systems by providing a new, improved, simple and effective reversing means in a reversible vapor compression system without compromising system efficiency. The present invention is characterized in that the main circuit which includes an interior and an exterior heat exchanger, communicates with a first sub-circuit, which includes a compressor, and a second sub-circuit, which includes an expansion device, through the first and second flow reversing device.

A second aspect of the invention relates to a reversible heat exchanger that can be used with reversible heat pump systems without compromising heat exchanger performance. It is characterized in that the refrigerant fluid flow in the heat exchanger can be changed from heating to cooling mode by means of flow changing devices provided between the heat exchanger sections.

An additional embodiment of the invention relates to vapor compression reversing defrost system which is a well-known method for defrosting a heat exchanger in for example a heat pump system using air as heat source. The present inventive embodiment is characterized in that the reversing process is performed using two reversing devices.

The field of application for the present invention can be, but is not limited to, stationary and mobile air-conditioning/heat pump units and refrigerators/freezers. In particular, the device can be used for room air conditioning and heat pump systems, and automotive air-conditioning/heat pump systems with internal combustion engine as well as electric or hybrid vehicles.

BRIEF DESCRIPTION OF THE DRAWINGS

The invention is described in more details by way of examples and by reference to the following figures, where.

DETAILED DESCRIPTION OF THE INVENTION

First Aspect of the Invention

Figure 1:
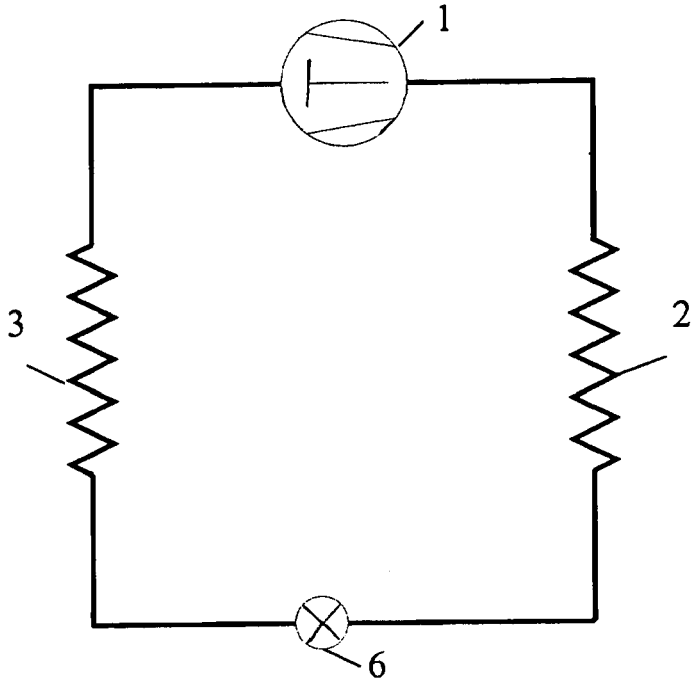
FIG. 1 (PRIOR ART)
FIG. 1 is a schematic representation of a non-reversible vapor compression system.

FIG. 1 shows a schematic representation of a non-reversible vapor compression system including a compressor 1, heat exchangers 2, 3 and an expansion device 6.

Figure 2:
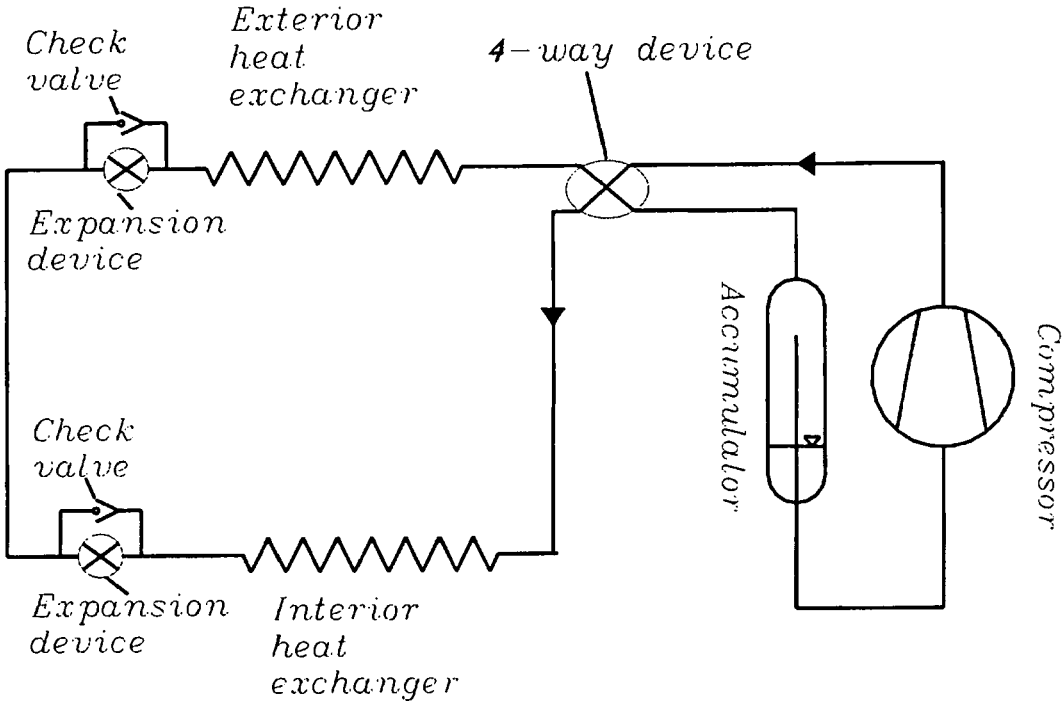
FIG. 2 (PRIOR ART)
FIG. 2 is a schematic representation of the most common system circuiting which is practiced for a reversible heat pump system.

FIG. 2 shows as stated above a schematic representation of the most common vapor compression system for a reversible heat pump system. The components included in such known system are denoted in the figure. The change of mode is obtained by using two different expansion valves with check valves in bypass and a 4-way valve.

First Embodiment of the Invention

Figure 3:
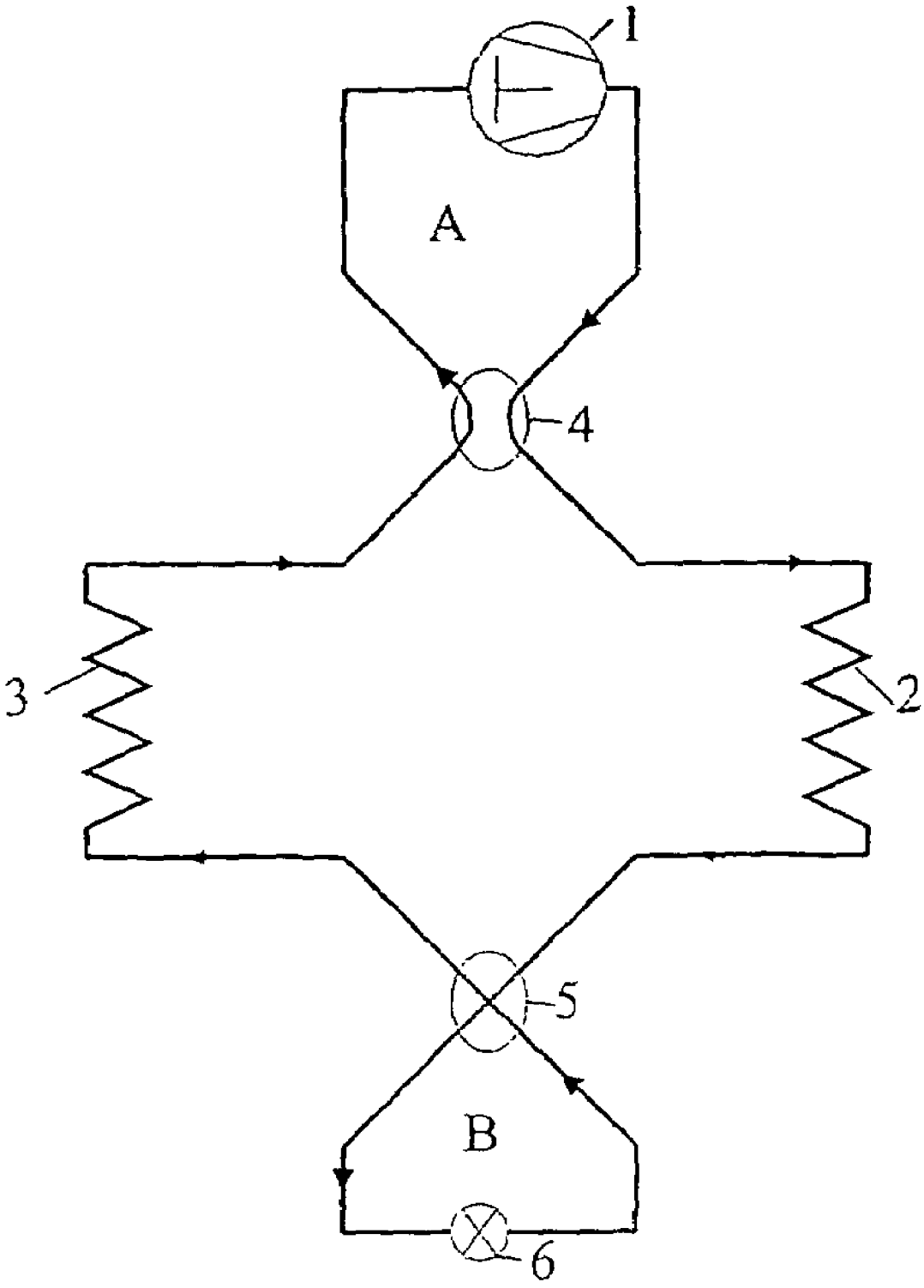
FIG. 3 is a schematic representation of a first embodiment in heating mode operation.
Figure 4:
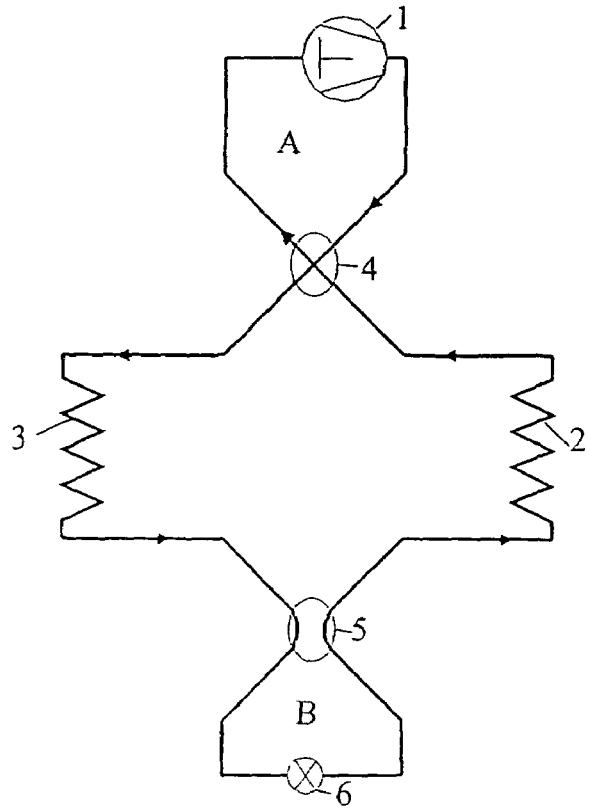
FIG. 4 is schematic representation of the first embodiment in cooling mode operation.

The first (basic) embodiment of the present invention for single-stage reversible vapor compression cycle is shown schematically in FIG. 3 in heating mode and in FIG. 4 for cooling operation. In accordance with the present invention, the system, as with the known system, includes a compressor 1, an interior heat exchanger 2, an expansion device 6 (for example a throttling valve) and an exterior heat exchanger 3. It is understood that the complete system comprises the connecting piping, in order to form a closed main flow circuit, in which a refrigerant is circulated. The inventive features of the first embodiment of the invention is the use of two sub-circuits, a first circuit A, and a second circuit B, connected respectively with the main flow circuit through a first 4 and second 5 flow reversing device that may for instance be in the form of a 4-way valve. The compressor 1 and the expansion device 6 are provided in the first sub-circuit A and in the second sub-circuit B respectively, whereas the interior heat exchanger 2 and exterior heat exchanger 3 are provided in the main circuit which communicates with the said sub-circuits through first and second flow reversing devices. This basic embodiment (which forms the building block of other derived embodiments in this patent) operate with minimum pressure drop in both heating and cooling mode, and as such without compromising system efficiency. In addition, it can easily incorporate new components to provide new embodiments that extend its applicability to include a wide range of reversible refrigeration and heat pump system applications as documented. This embodiment and the resulting deduced embodiments without ow-pressure receiver/accumulator have the advantage that eliminates the need for an additional oil-return management. The reversing of the process from cooling mode operation to heating mode operation is performed simply and efficiently by the two flow reversing devices 4 and 5 which connect the main circuit to sub-circuit A and sub-circuit B, respectively. The operating principle is as follows:

Heat Pump Operation:

Referring to FIG. 3, flow reversing devices 4 and 5 are in heating mode position such that exterior heat exchanger 3 acts as an evaporator and interior heat exchanger 2 as a gas cooler (condenser). The circulating refrigerant evaporates in the exterior heat exchanger 3 by absorbing heat from the heat source. The vapor passes through the flow reversing device 4 before it is drawn off by the compressor 1. The pressure and temperature of the vapor is increased by the compressor 1 before it enters the interior heat exchanger 2 by passing through the flow reversing device 4. Depending on the pressure, the refrigerant vapor is either condensed (at sub-critical pressure) or cooled (at supercritical pressure) by giving off heat to the heat sink (interior air in case of air system). The high-pressure refrigerant then passes through the flow reversing device 5 before its pressure is reduced by the expansion device 6 to the evaporation pressure. The refrigerant passes through the flow reversing device 5 before entering the exterior heat exchanger 3, completing the cycle.

Cooling Mode Operation:

Referring to FIG. 4, flow reversing devices 4 and 5 are in cooling mode position such that interior heat exchanger 2 acts as an evaporator and exterior heat exchanger 3 as a gas cooler (condenser). The circulating refrigerant evaporates in the interior heat exchanger 2 by absorbing heat from the interior coolant. The vapor passes through the flow reversing device 4 before it is sucked by the compressor 1. The pressure and temperature of the vapor is increased by the compressor 1 before it enters the exterior heat exchanger 3 by passing through the flow reversing device 4. Depending on the pressure, the refrigerant vapor is either condensed (at sub-critical pressure) or cooled (at supercritical pressure) by giving off heat to the heat sink. The high-pressure refrigerant then passes through the flow reversing device 5 before its pressure is reduced by the expansion device 6 to the evaporation pressure. The low-pressure refrigerant passes through the flow-reversing device 5 before entering the interior heat exchanger 2, completing the cycle.

The main advantage of this embodiment is that it requires a minimum number of components and simple operation and control principle. On the other hand, in the absence of any receiver/accumulator, the energy efficiency and overall system performance becomes sensitive to cooling/heating load variation and any eventual refrigerant leakage.

Second Embodiment of the Invention

Figure 5:
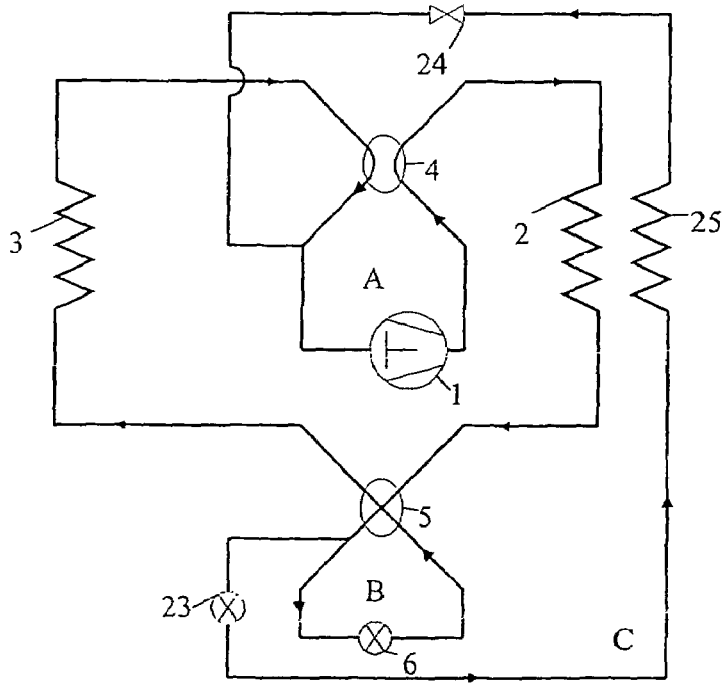
FIG. 5 is schematic representation of a second embodiment in heating mode operation.
Figure 6:
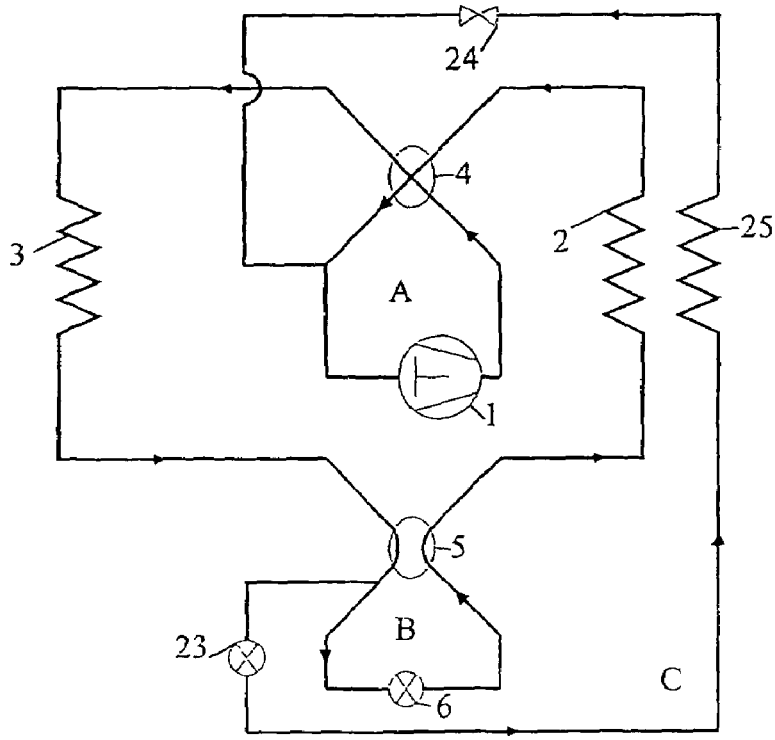
FIG. 6 is a schematic representation of the second embodiment in cooling mode operation.

FIGS. 5 and 6 show schematic representations of the second embodiment in heating and cooling mode operation respectively. Compared to the first embodiment, it has an additional conduit loop C which includes a heat dehumidification exchanger 25, an expansion device 23 and a valve 24. The heat exchanger 25 has dehumidifying function during heating mode operation whereas it works as an ordinary evaporator in cooling mode. During heating mode, some of the high-pressure refrigerant after reversing device 5 is bleeded through expansion device 23 by which the refrigerant pressure is reduced to evaporation pressure in the said heat exchanger. The said refrigerant is then evaporated by absorbing heat in the heat exchanger 25 before it passes through the valve 24. In this way, the interior air passes through the dehumidification heat exchanger 25 before it is heated up again by interior heat exchanger 2, providing dryer air into the interior space for defogging purposes such as windshield in mobile air conditioning system. In cooling mode, the heat exchanger 25 provides additional heat transfer area for cooling of the interior air. The reversing of the system is performed as in the first embodiment by changing the position of the two flow reversing devices 4 and 5 from heating to cooling mode and vice versa.

Third Embodiment of the Invention

Figure 7:
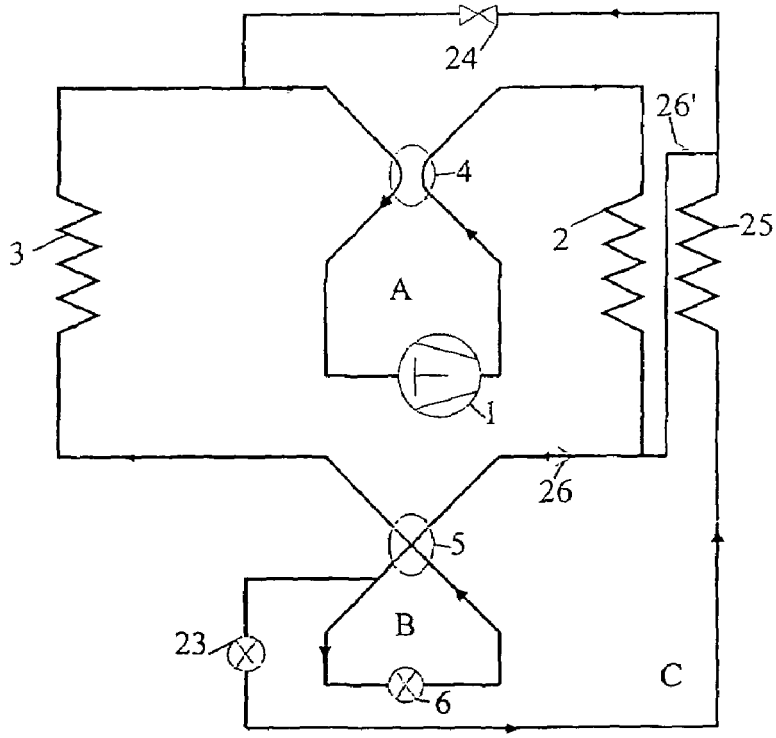
FIG. 7 is a schematic representation of a third embodiment in heating mode operation.
Figure 8:
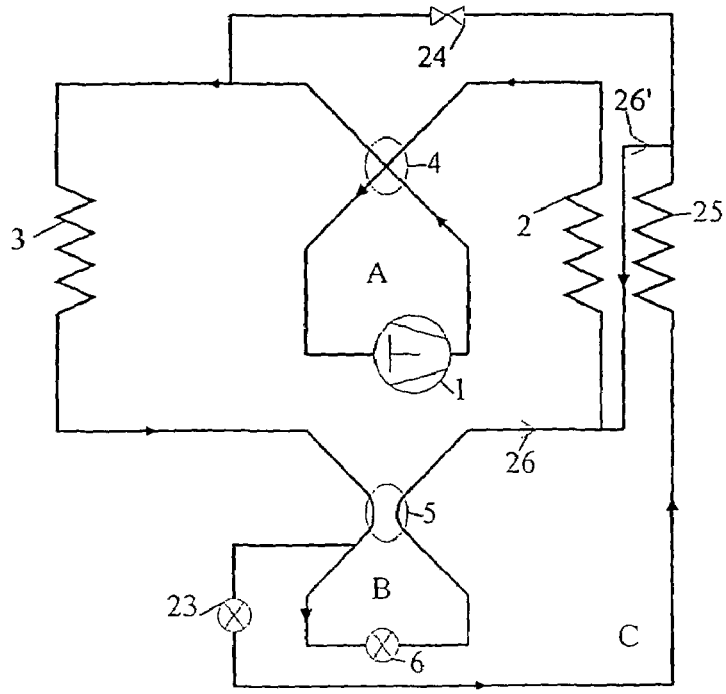
FIG. 8 is a schematic representation of the third embodiment in cooling mode operation.

FIGS. 7 and 8 show schematic representations of the third embodiment in heating and cooling mode operation respectively. Compared to the second embodiment, the arrangement of the conduit loop C relative the main circuit is such that the dehumidification heat exchanger 25 and interior heat exchanger 2 are coupled in series during cooling mode operation by providing additional flow changing devices 26 and 26' (for example check valve) as opposed to the second embodiment where the said heat exchangers are couples in parallel regardless of operational mode. The reversing of the system is performed as in the first embodiment by changing the position of the two flow reversing devices 4 and 5 from heating to cooling mode and vice versa.

Fourth Embodiment of the Invention

Figure 9:
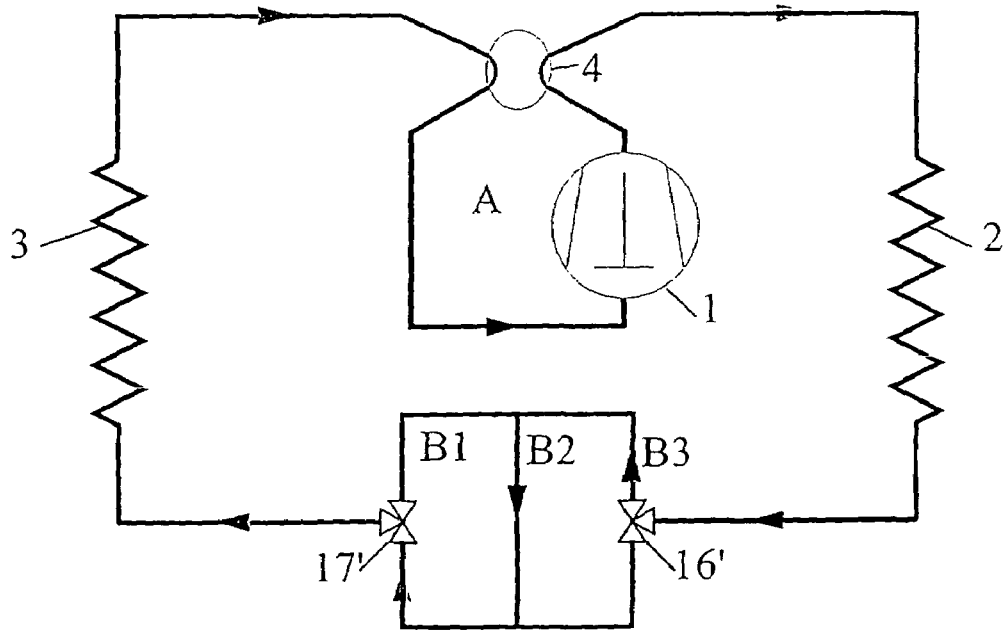
FIG. 9 is a schematic representation of a fourth embodiment in heat pump mode operation.
Figure 10:
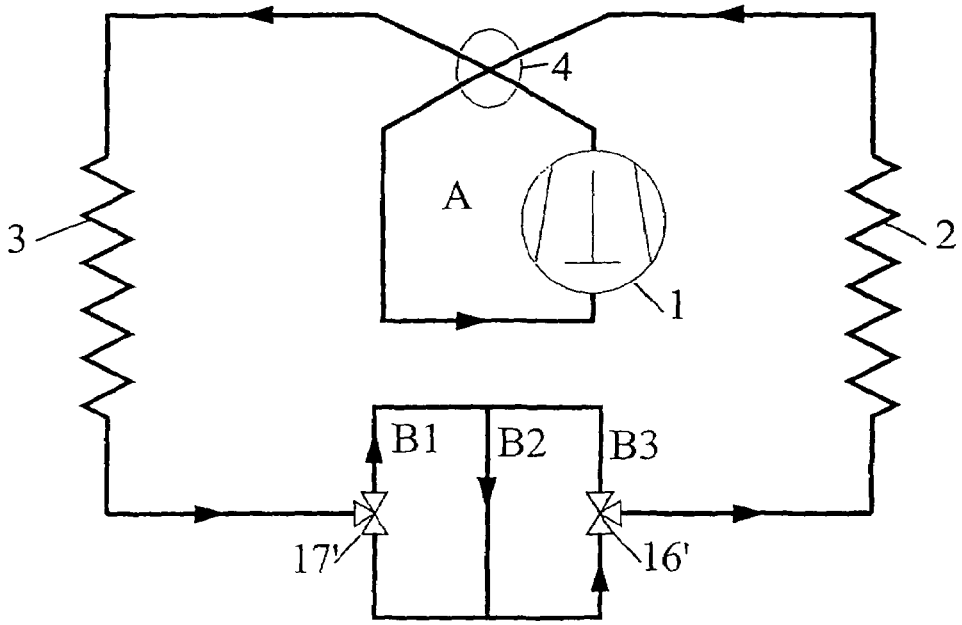
FIG. 10 is a schematic representation of the fourth embodiment in cooling mode operation.

This is an improvement of the first embodiment and is shown schematically in FIG. 9 in heating mode and in FIG. 10 in cooling mode. In accordance with this invention, the device includes a compressor 1, a sub-circuit with a flow reversing device 4, an interior heat exchanger 2 and an exterior heat exchanger 3. The difference from the former embodiment is that the second sub-circuit B with flow reversing device 5 is replaced by a sub-circuit including three interconnected parallel conduit branches B1, B2, B3, that is connected to the main circuit through flow diverting expansion devices 16' and 17'. The reversing of the process from cooling mode operation to heating mode operation is performed simply and efficiently by the flow reversing device 4 and two flow diverting expansion devices 16' and 17'. The operating principle is as follows:

Heat Pump Operation:

Referring to FIG. 9, the flow reversing device 4 and the flow diverting expansion devices 16' and 17' are in heating mode position such that exterior heat exchanger 3 acts as an evaporator and interior heat exchanger 2 as a gas cooler (condenser). The circulating refrigerant evaporates in the exterior heat exchanger 3 by absorbing heat from the heat source. The vapor passes through the flow reversing device 4 before it is sucked by the compressor 1. The pressure and temperature of the vapor is increased by the compressor 1 before it enters the interior heat exchanger 2 by passing through the flow reversing device 4. Depending on the pressure, the refrigerant vapor is either condensed (at sub-critical pressure) or cooled (at supercritical pressure) by giving off heat to the heat sink (interior air in case of air system). The high-pressure refrigerant then passes through the first flow diverting expansion device 16' before its pressure is reduced by the second flow diverting expansion device 17' to the evaporation pressure in the interior heat exchanger 3, completing the cycle.

Cooling Mode Operation:

Referring to FIG. 10, the flow reversing device 4 and the flow diverting expansion devices 16' and 17' are in cooling mode position such that interior heat exchanger 2 acts as an evaporator and exterior heat exchanger 3 as a gas cooler (condenser). The circulating refrigerant evaporates in the interior heat exchanger 2 by absorbing heat from the interior coolant. The refrigerant passes through the flow reversing device 4 before it is drawn off by the compressor 1. The pressure and temperature of the vapor is increased by the compressor 1 before it enters the exterior heat exchanger 3 by passing through the flow reversing device 4. Depending on the pressure, the refrigerant vapor is either condensed (at sub-critical pressure) or cooled (at supercritical pressure) by giving off heat to the heat sink. The high-pressure refrigerant then passes through the first flow diverting expansion device 17' before its pressure is reduced by the second flow diverting expansion device 16' to the evaporation pressure in the exterior heat exchanger 2, completing the cycle.

Fifth Embodiment of the Invention

Figure 11:
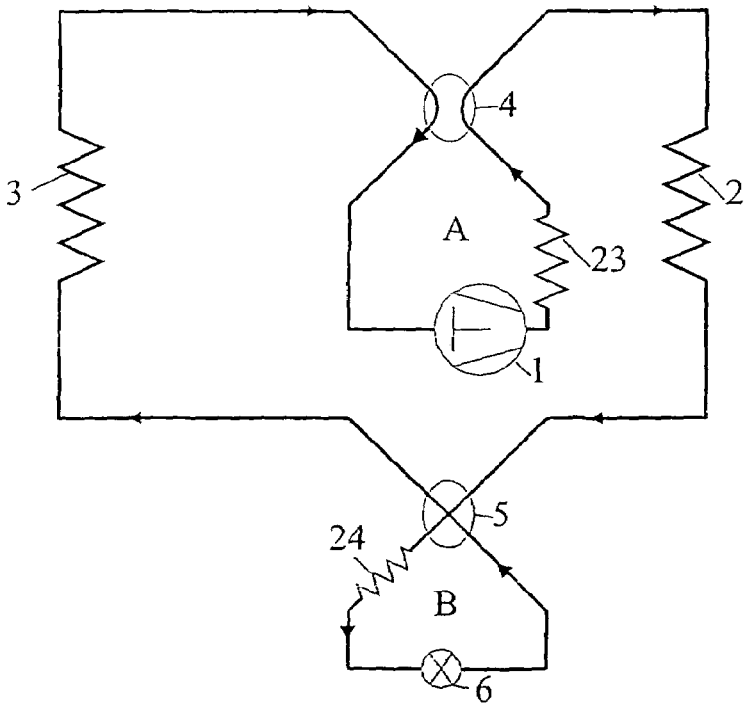
FIG. 11 is a schematic representation of a fifth embodiment in heat pump mode operation.
Figure 12:
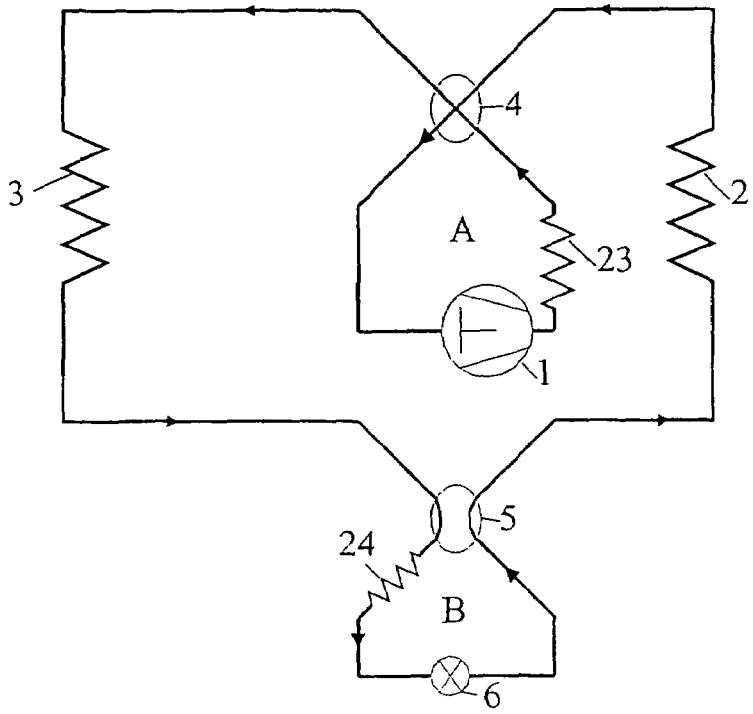
FIG. 12 is a schematic representation of the fifth embodiment in cooling mode operation.

FIGS. 11 and 12 show schematic representations of the fifth embodiment in heating and cooling mode operation respectively. This embodiment represents a reversible vapor compression system with tap water heating function. The tap water is preheated first by the heat exchanger 24 provided in sub-circuit B before it is further heated up to the desired temperature by the second water heater heat exchanger 23 in sub-circuit A. The heat load on the water heater heat exchanger 23 can be regulated either by varying water flow rate in the heat exchanger 23 or by a bypassing arrangement on the refrigerant side of said heat exchanger.

Sixth Embodiment of the Invention

Figure 13:
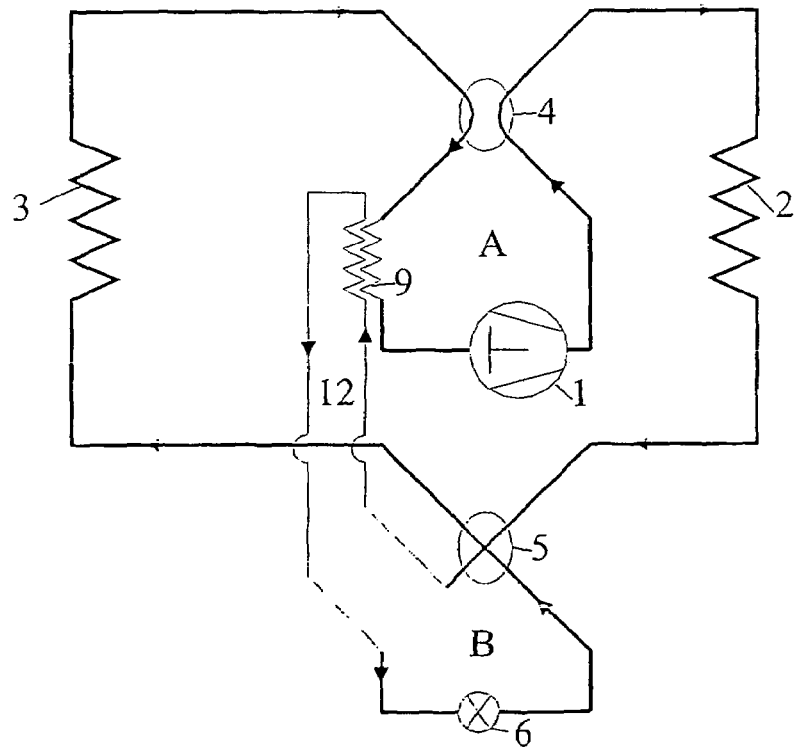
FIG. 13 is a schematic representation of a sixth embodiment in heat pump mode operation.
Figure 14:
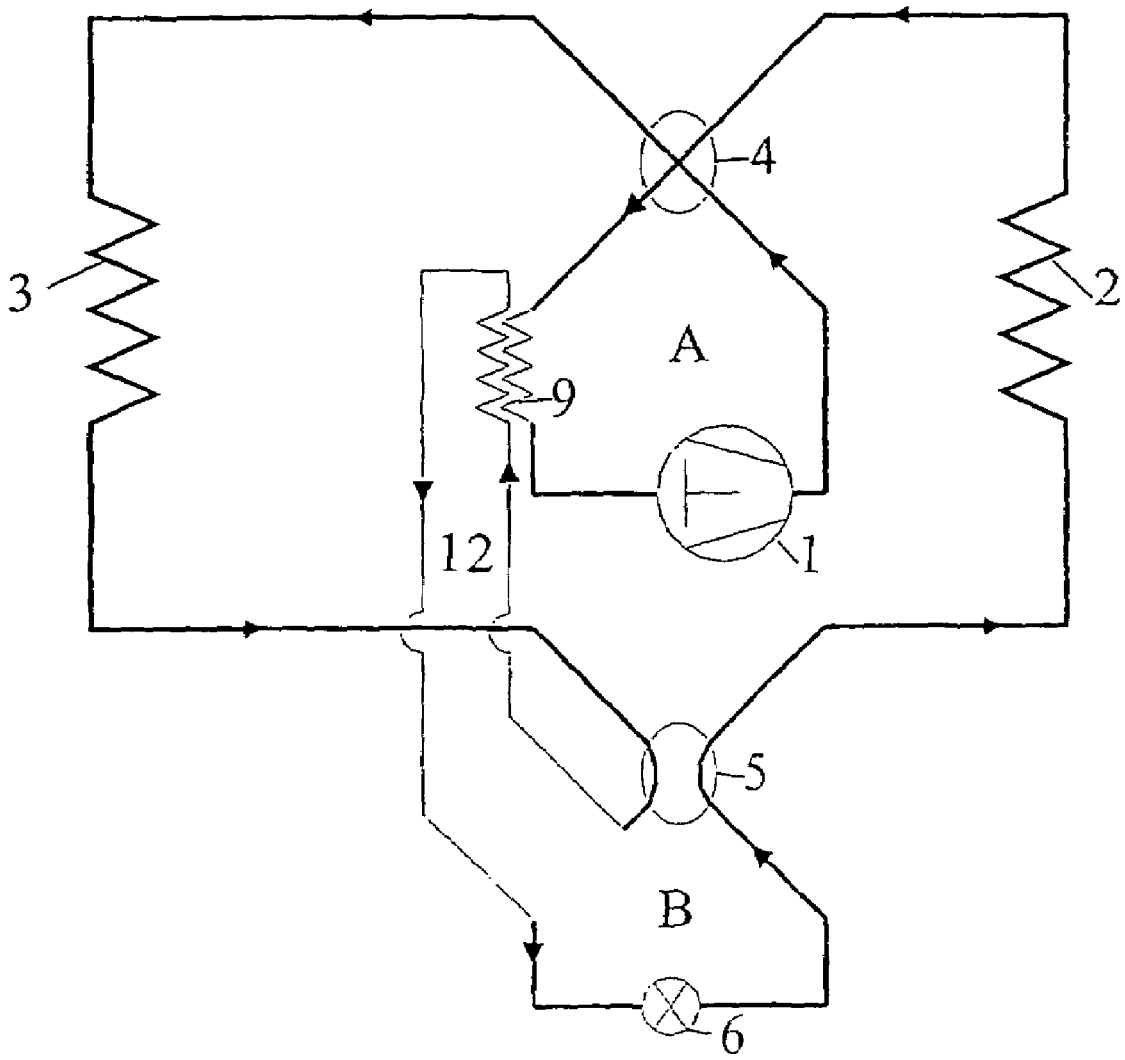
FIG. 14 is a schematic representation of the sixth embodiment in cooling mode operation.

FIGS. 13 and 14 show schematic representations of the sixth embodiment which is an improvement of the first embodiment of the invention. Compared to the first embodiment, this embodiment has an additional counter flow internal heat exchanger 9 provided in sub-circuit A and exchanging heat with the refrigerant in sub-circuit B through a conduit loop connection 12. Tests conducted on a prototype vapor compression unit running in cooling mode show that the addition of an internal heat exchanger can result in lower energy consumption and higher cooling capacity at high heat sink temperature (high cooling load). The reversing process is performed as in the first embodiment.

Seventh Embodiment of the Invention

Figure 15:
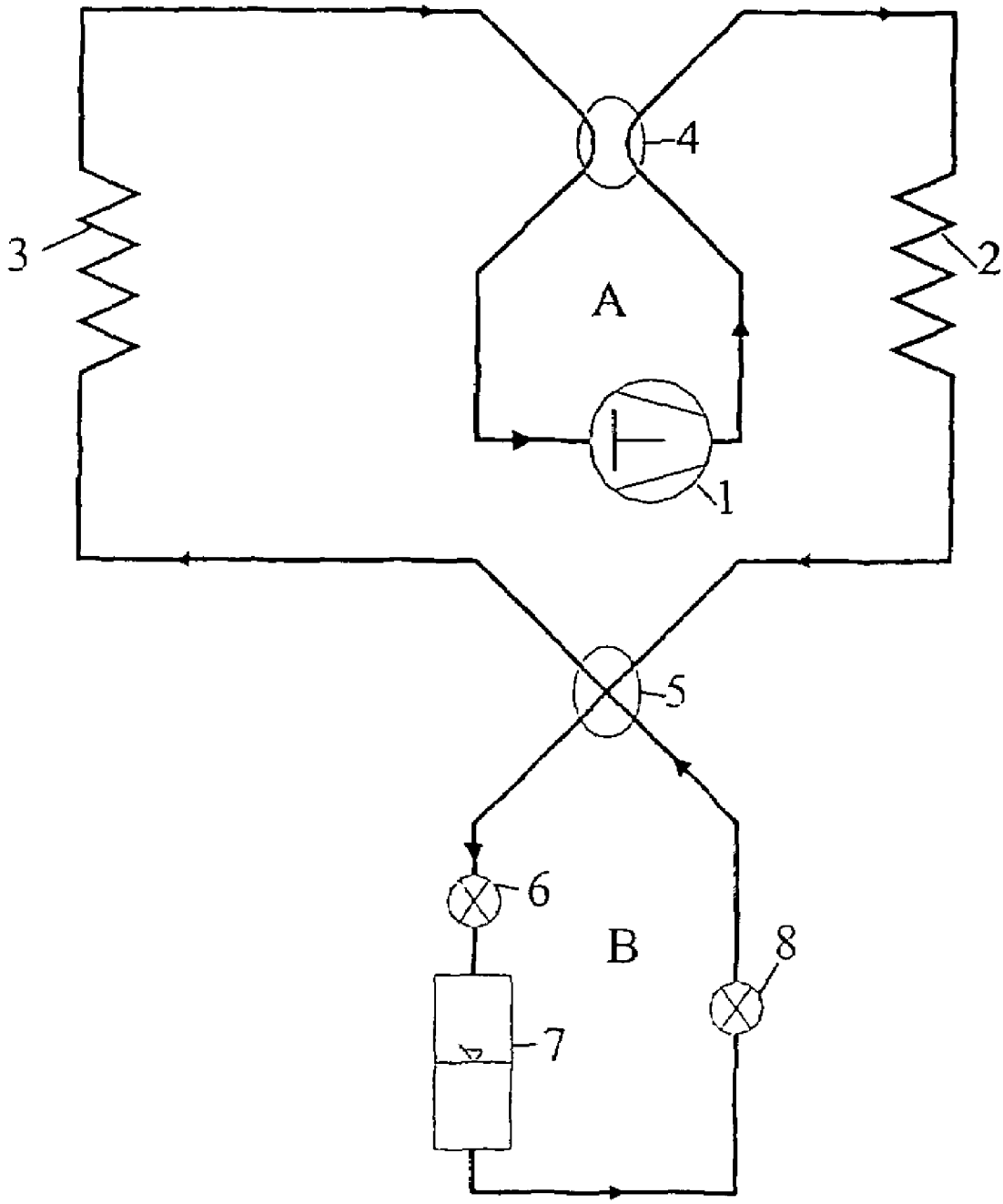
FIG. 15 is a schematic representation of a seventh embodiment in heat pump mode operation.
Figure 16:
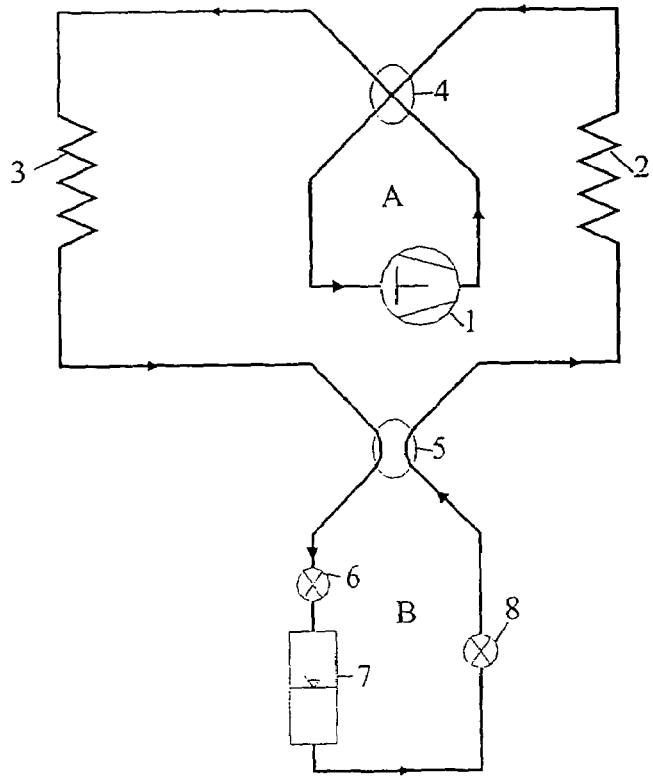
FIG. 16 is a schematic representation of the seventh embodiment in cooling mode operation.

The seventh embodiment of the invention is shown schematically in FIG. 15 in heating mode and FIG. 16 in cooling mode. The main difference between this embodiment and the first embodiment is the presence of the intermediate-pressure receiver/accumulator 7 provided in the sub-circuit B that result in a two-stage expansion of high-pressure refrigerant. In accordance with this embodiment, the reversible vapor compression device includes a compressor 1, a flow reversing device 4, another flow reversing device 5, an expansion device 6 and an exterior heat exchanger. The reversing process is performed as before by means of changing the position of the two flow reversing devices 4 and 5 from heating to cooling mode and vice versa. This embodiment improves the first embodiment by the introduction of the intermediate-pressure receiver/accumulator 7 that allows active high-side pressure and cooling/heating capacity control in order to maximize the COP or capacity. The system becomes more robust and is not effected by eventual leakage as long as there is a refrigerant liquid level in the intermediate-pressure receiver/accumulator 7.

Eighth Embodiment of the Invention

Figure 17:
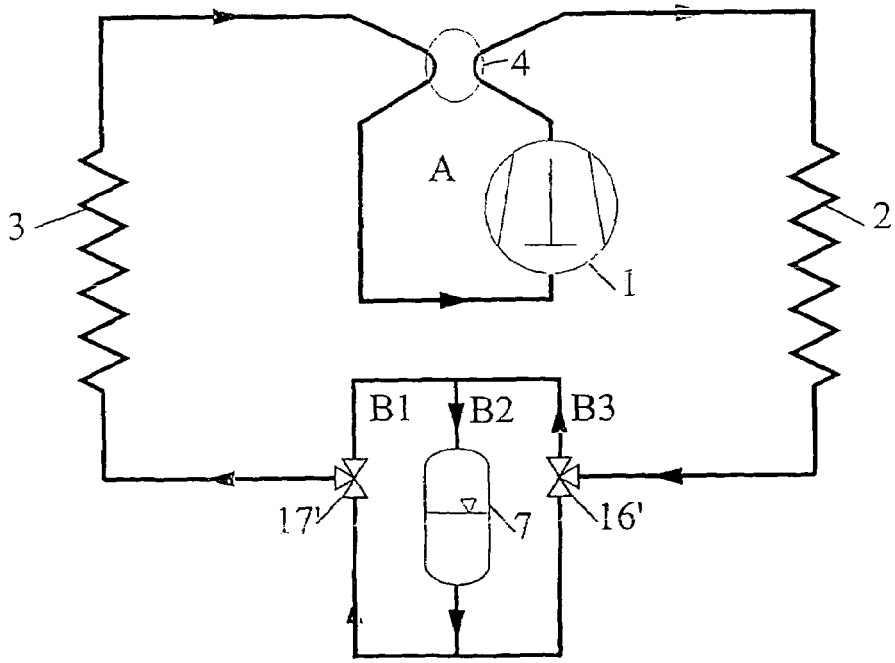
FIG. 17 is a schematic representation of an eighth embodiment in heat pump mode operation.
Figure 18:
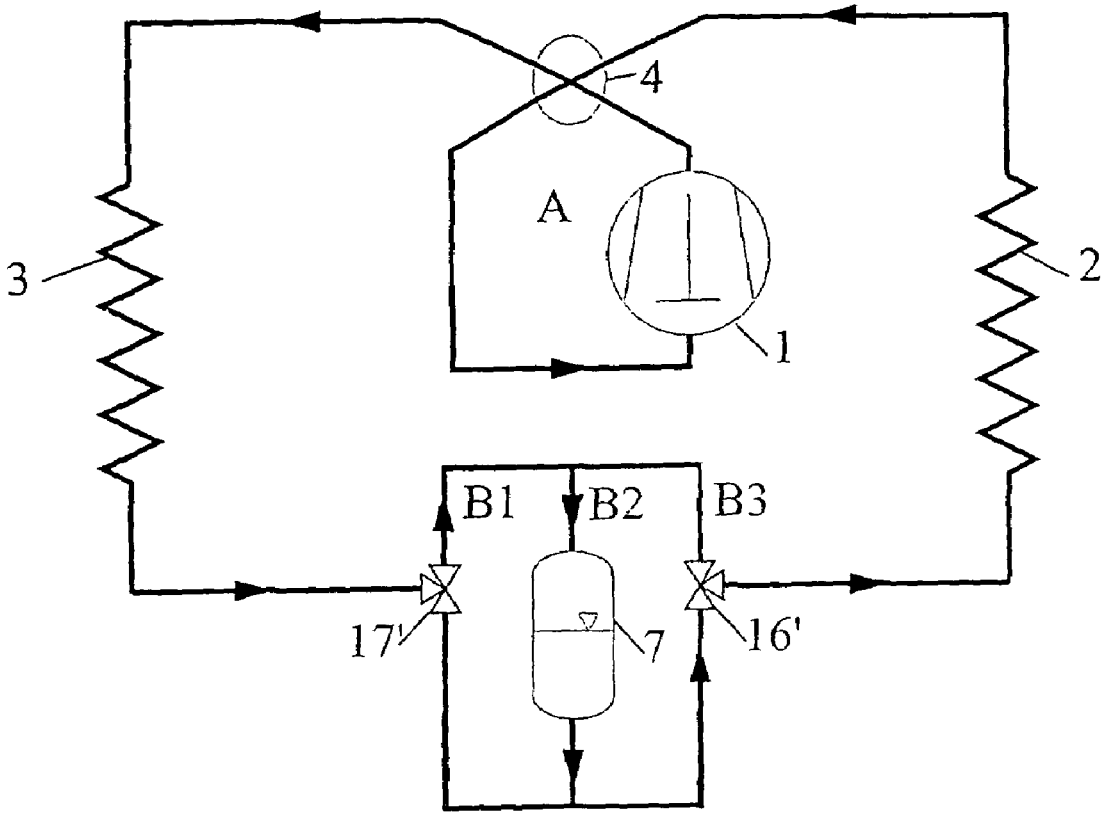
FIG. 18 is a schematic representation of the eighth embodiment in cooling mode operation.

The eighth embodiment, is an improvement of the fourth embodiment and is shown schematically in FIG. 17 in heating mode and FIG. 18 in cooling mode. The main difference between this embodiment and the fourth embodiment is the presence of the intermediate-pressure receiver/accumulator 7 provided in the middle branch B2 of the second sub circuit B that result in two-stage expansion of high-pressure refrigerant through the flow diverting expansion devices 16' and 17' respectively. The system becomes more robust and is not effected by eventual leakage as long as there is a refrigerant liquid level in the intermediate-pressure receiver/accumulator 7.

Ninth Embodiment of the Invention

Figure 19:
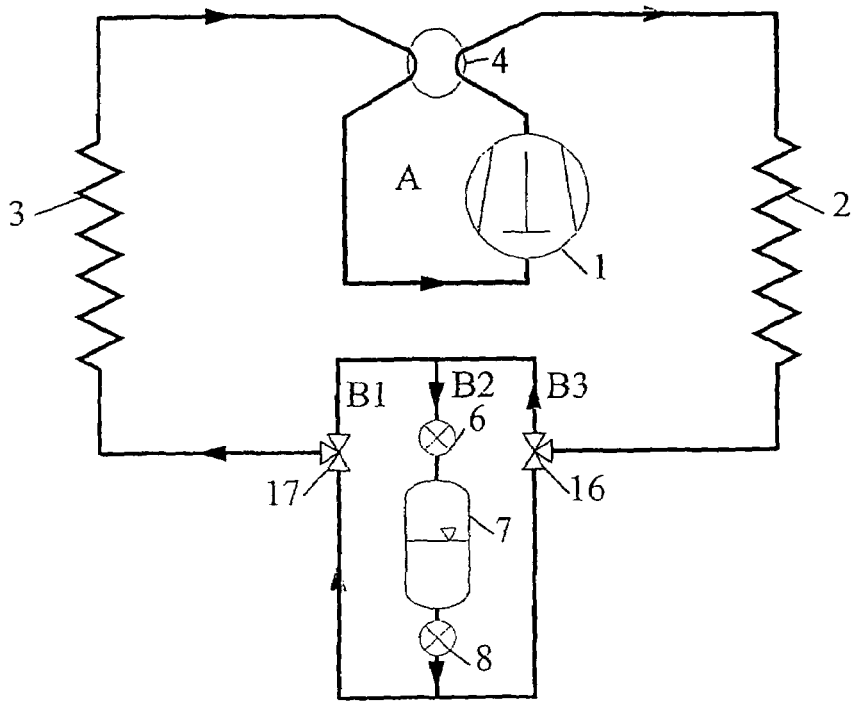
FIG. 19 is a schematic representation of a ninth embodiment in heat pump mode operation.
Figure 20:
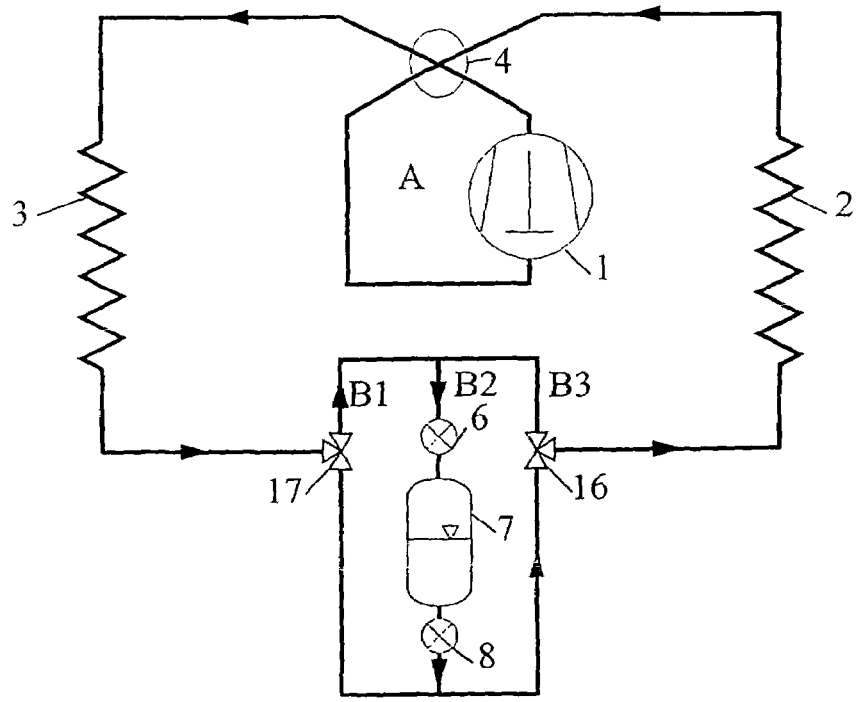
FIG. 20 is a schematic representation of the ninth embodiment in cooling mode operation.

The ninth embodiment of the invention is shown schematically in FIG. 19 in heating mode and FIG. 20 in cooling mode. This embodiment is the same as the eighth embodiment except that the flow diverting and expansion function of the devices 16' and 17' are decomposed into two separate diverting device 16 and 17, and two expansion devices 6 and 8 provided in the middle branch B2, above respectively below the receiver/accumulator 7. According to this embodiment, it comprises a compressor 1, a flow reversing device 4, an interior heat exchanger 2, a flow diverting devices 16, an expansion device 6, an intermediate-pressure receiver/accumulator 7, an expansion device 8, a flow diverting device 17 and an exterior heat exchanger. In this embodiment the reversing of the system is achieved by the use of one flow reversing device 4 and the two flow diverting devices 16 and 17 that are positioned in either cooling or heating mode.

Tenth Embodiment of the Invention

Figure 21:
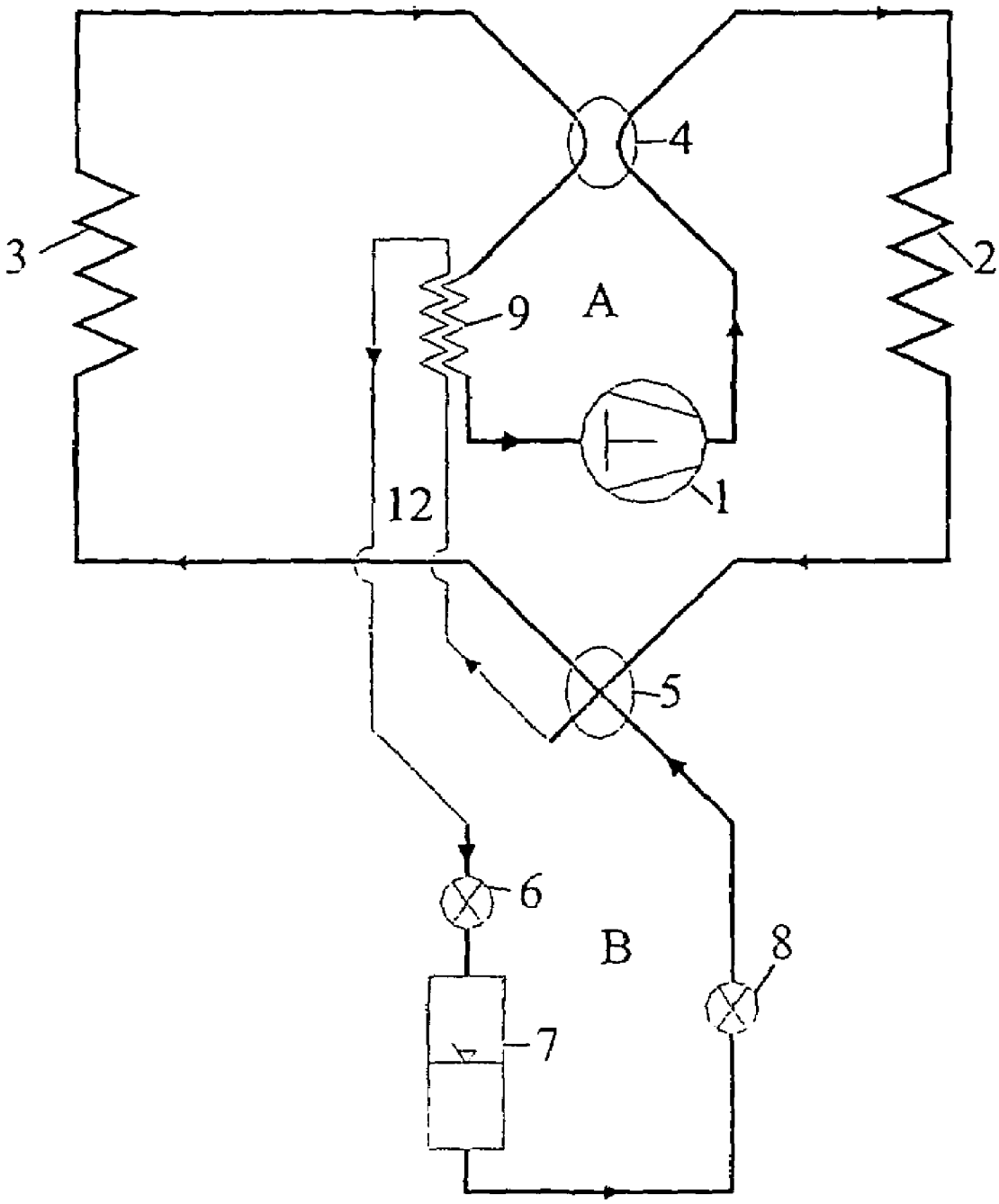
FIG. 21 is a schematic representation of a tenth embodiment in heat pump mode operation.
Figure 22:
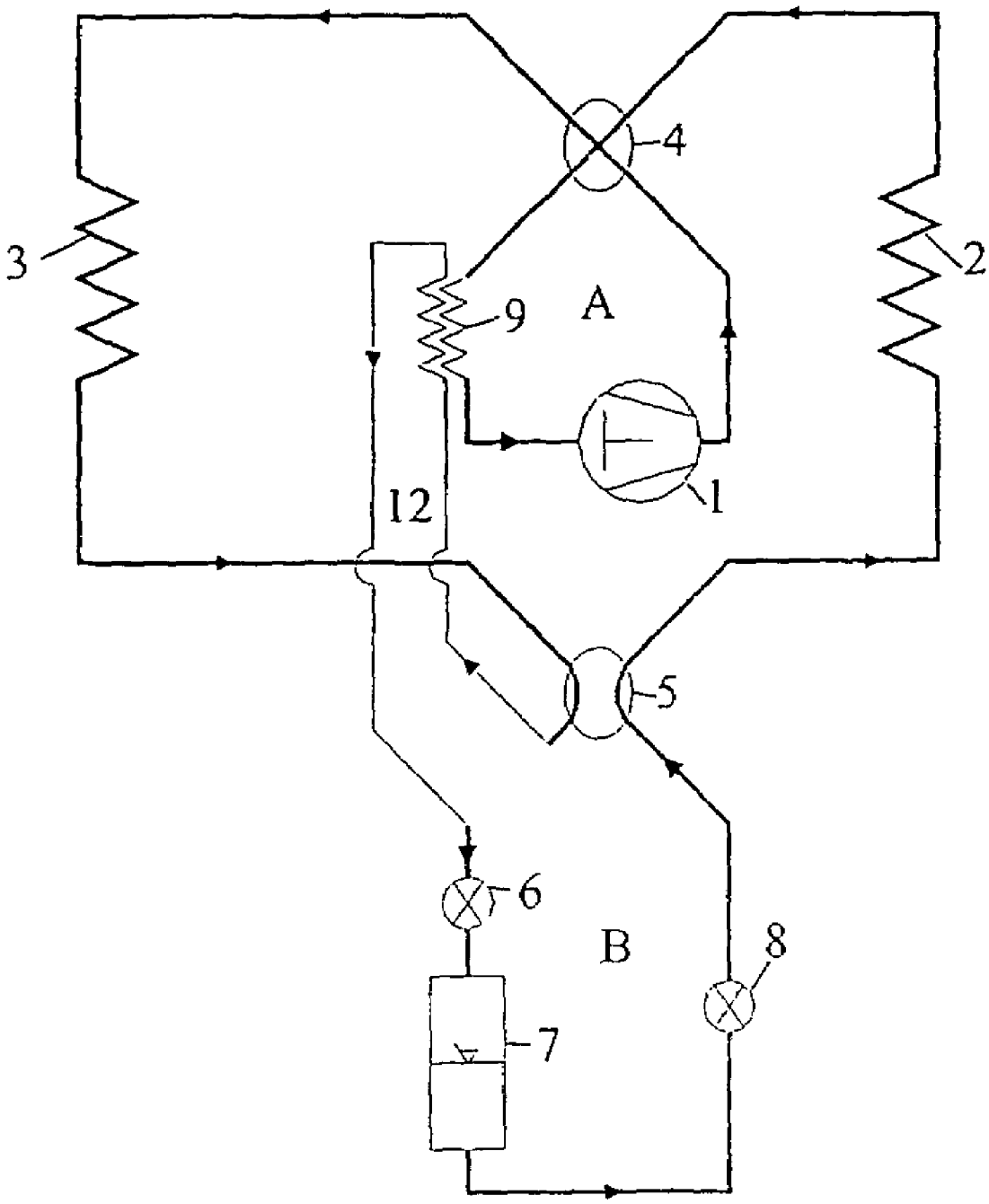
FIG. 22 is a schematic representation of the tenth embodiment in cooling mode operation.

The tenth embodiment is shown in FIG. 21 in heating mode and in FIG. 22 in cooling mode. Compared to the seventh embodiment, this embodiment includes an addition of a counter flow internal heat exchanger 9 provided in sub-circuit A and which exchanges heat with sub-circuit B through a conduit loop 12 that is coupled to sub circuit B prior to the expansion device 6. Tests conducted on a prototype vapor compression unit running in cooling mode show that the addition of an internal heat exchanger can result in lower energy consumption and higher cooling capacity at high heat sink temperature (high cooling load). The operating principle is as in the fifth embodiment except for the fact that the warm high-pressure refrigerant after the flow reversing device 5 exchanges heat through the internal heat exchanger 9 with the cold low-pressure refrigerant after the flow reversing device 4, before being expanded by the expansion device 6 into intermediate-pressure receiver/accumulator 7. The reversing process is performed as in the first embodiment.

Eleventh Embodiment of the Invention

Figure 23:
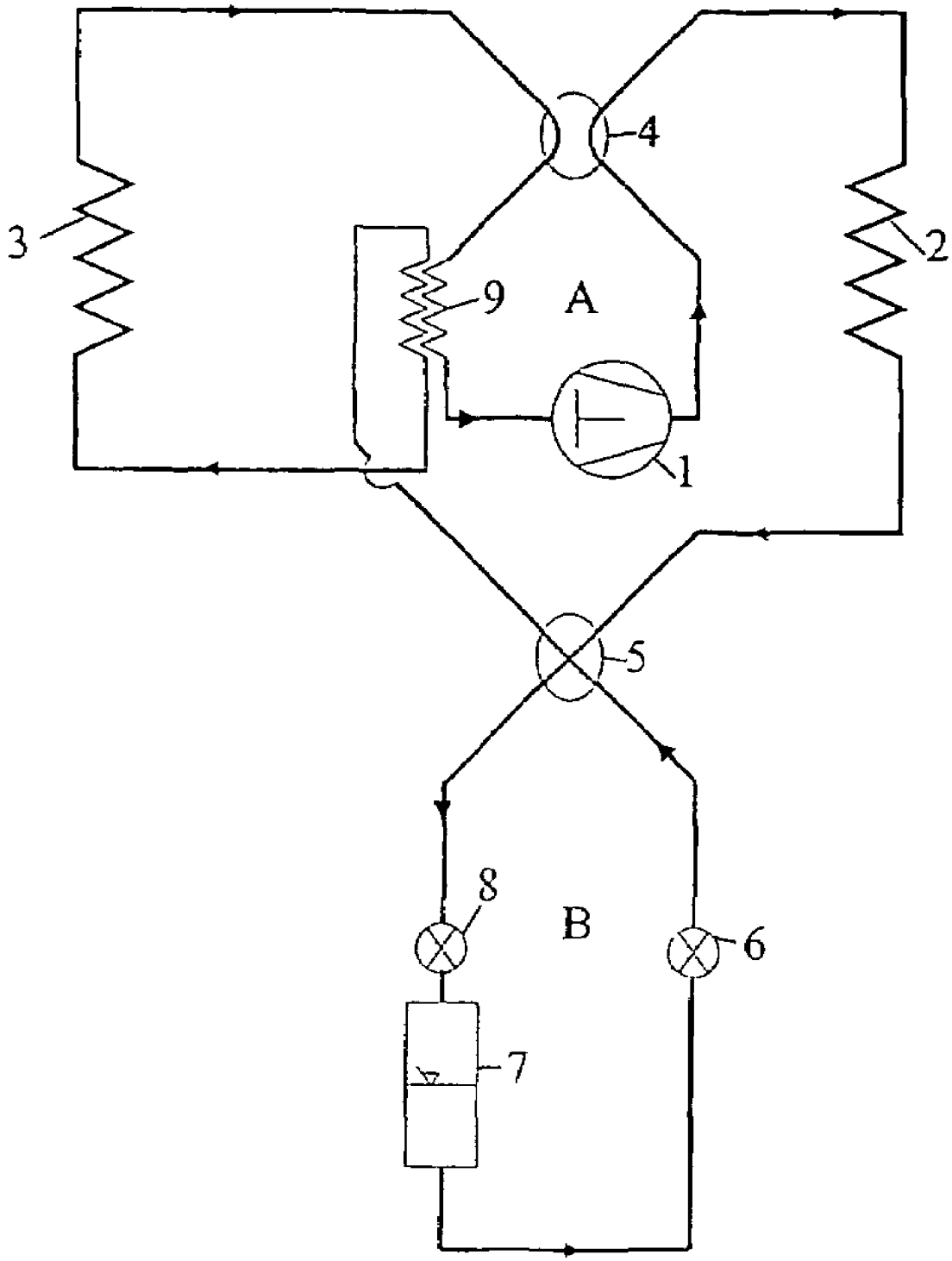
FIG. 23 is a schematic representation of a eleventh embodiment in heat pump mode operation.
Figure 24:
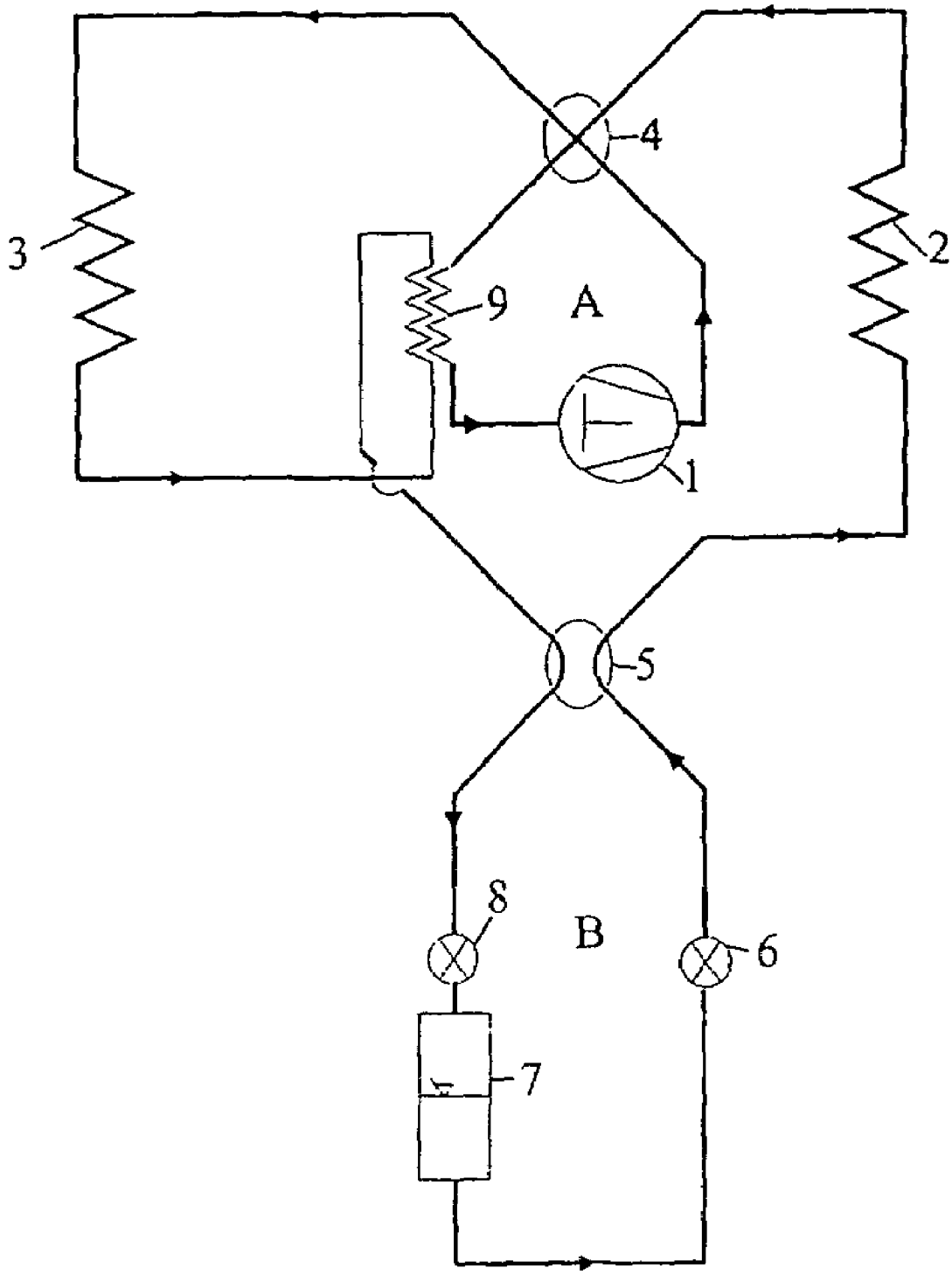
FIG. 24 is a schematic representation of the eleventh embodiment in cooling mode operation.

The eleventh embodiment of the invention is shown in FIG. 23 in heating mode and in FIG. 24 in cooling mode operation. The main difference between this embodiment and the tenth embodiment is the location of the high-pressure side of the counter flow internal heat exchanger 9. According to the eighth embodiment the high-pressure side of the internal heat exchanger 9 is placed in the sub-circuit B between the reversing device 5 and the expansion device 8 while in this embodiment, the high-pressure side of the internal heat exchanger 9 is placed between the reversing device 5 and the exterior heat exchanger 3. As a result, according to this embodiment, the internal heat exchanger will not be "active" in either heating or cooling mode operation since there is very limited temperature driving force for exchange of heat.

Twelfth Embodiment of the Invention

Figure 25:
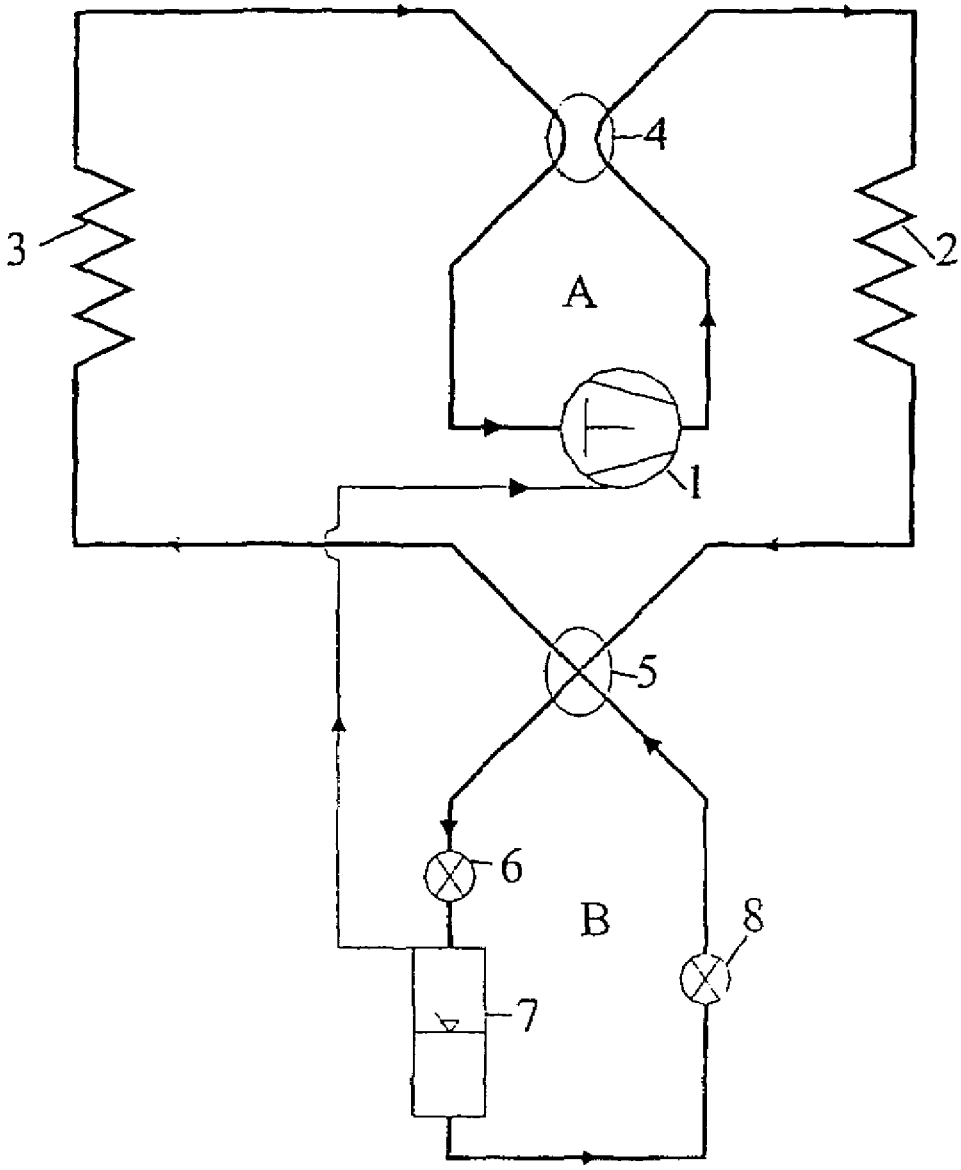
FIG. 25 is a schematic representation of a twelfth embodiment in heat pump mode operation.
Figure 26:
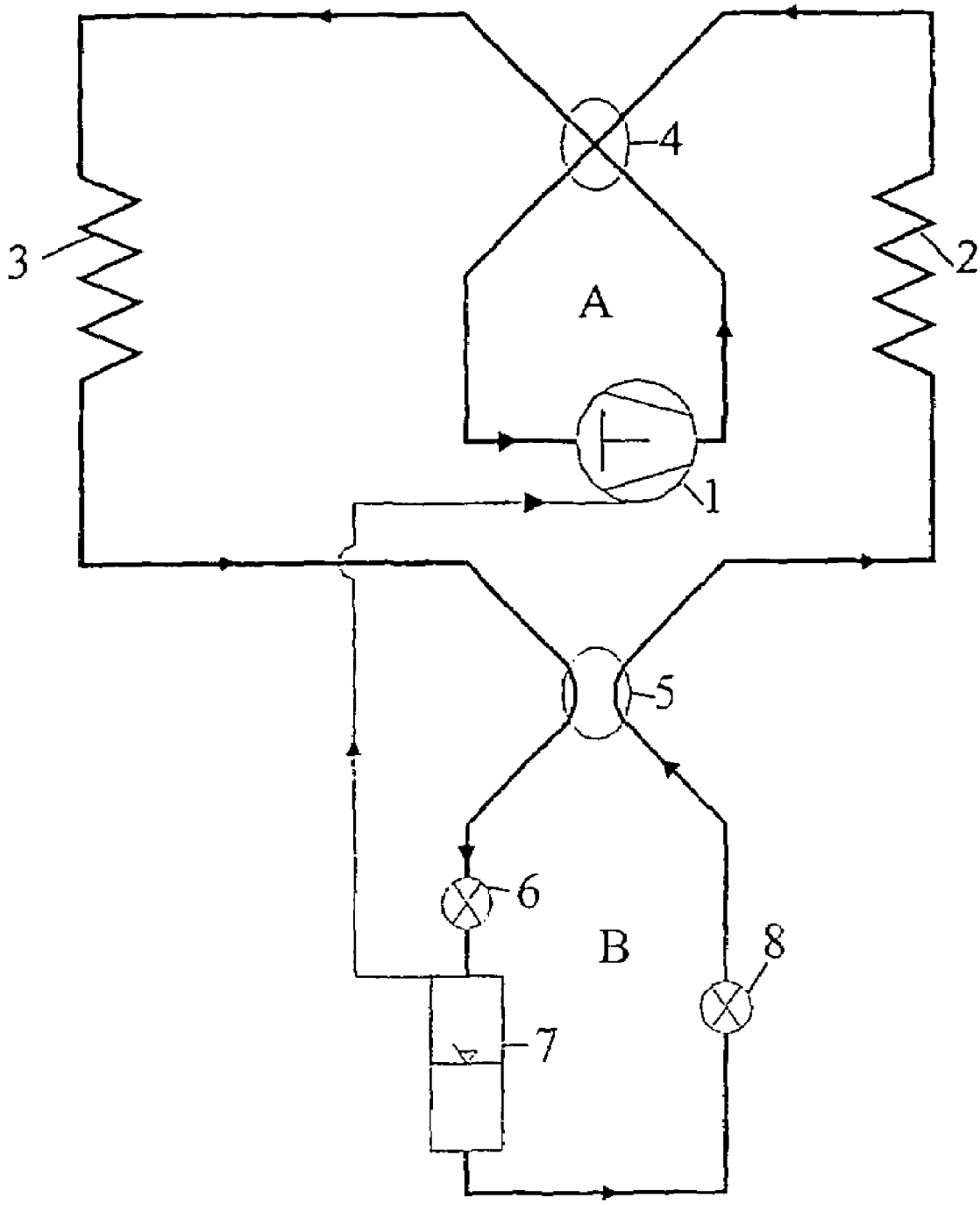
FIG. 26 is a schematic representation of the twelfth embodiment in cooling mode operation.

This embodiment is shown in FIG. 25 in heating mode and in FIG. 26 in cooling mode operation. This embodiment is a two-stage reversible vapor compression device where the compression process is carried out in two stages by drawing off vapor at intermediate pressure, through a conduit 20, from the receiver/accumulator 7 in sub-circuit B, resulting in better vapor compression efficiency. In addition, this embodiment allows for more control over the choice of resulting intermediate pressure in the intermediate-pressure receiver/accumulator 7. The compressor 1 can be a single compound unit with intermediate suction port or two separate, first stage and second stage, compressors of any type. The compressor can also be of "dual-effect compression" type (G. T. Voorhees 1905, British Patent No. 4448) where the cylinder of a reciprocating compressor is furnished with a port which is uncovered at or near the bottom-dead-center of the piston, inducing vapor at intermediate pressure and thereby increasing the cooling or heating capacity of the system. Using a "dual-effect" compressor with variable stroke (swept volume), the port can be uncovered only when the heating or cooling demand is high, in order to boost the system capacity. The operating principle in this embodiment is as in the first embodiment except for the fact that the compression process is carried out in two stages and the resulting flash vapor in the intermediate-pressure receiver/accumulator 7, after the expansion device 6, is drawn off by the second stage compressor through the piping 12. In cases where a compound unit or two separate compressors are used, the cold flash vapor is mixed with the discharge gas from the first stage compression resulting in lower gas temperature at the start of the second stage compression process. As a result the total work of compression for this embodiment will be less than single stage reversible transcritical vapor compression embodiments, with resulting higher energy efficiency in general.

Thirteenth Embodiment of the Invention

Figure 27:
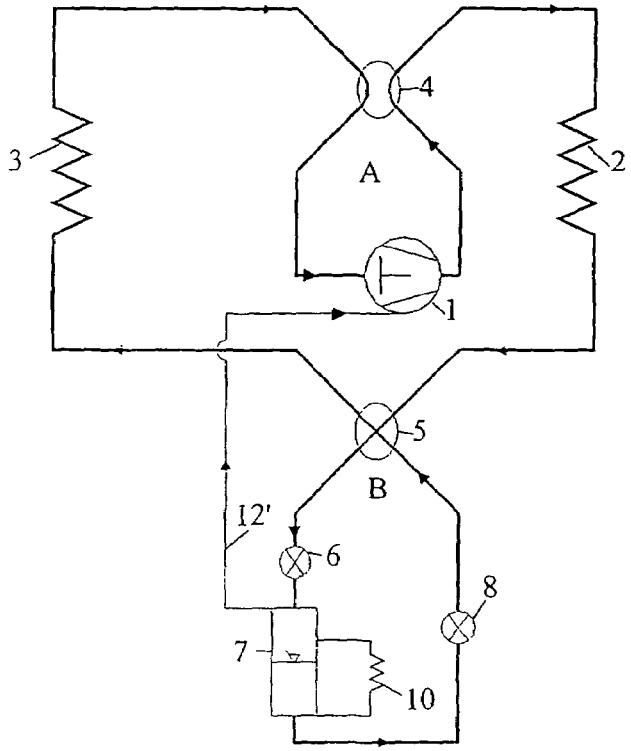
FIG. 27 is a schematic representation of a thirteenth embodiment in heat pump mode operation.
Figure 28:
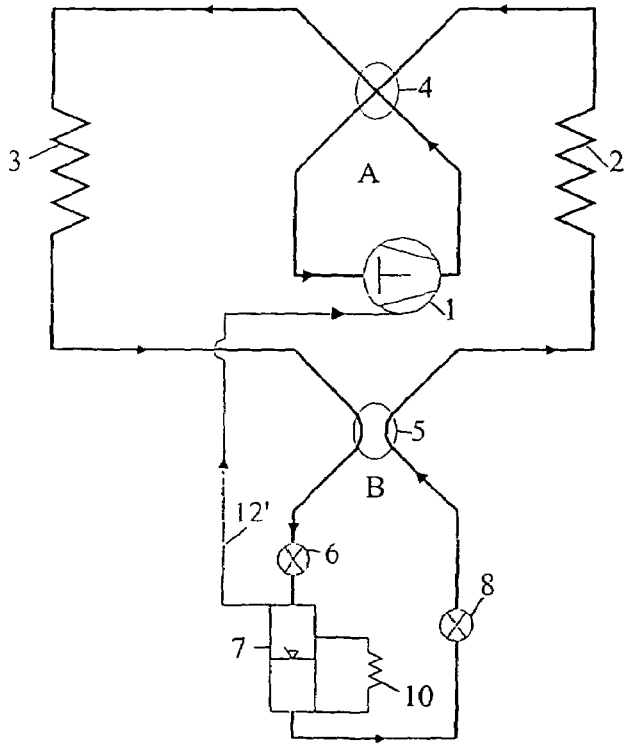
FIG. 28 is a schematic representation of the thirteenth embodiment in cooling mode operation.

The thirteenth embodiment is shown schematically in FIGS. 27 and 28 in heating and cooling mode, respectively. Compared to the twelfth embodiment, it has an extra heat exchanger 10 which provide additional cooling capacity at intermediate pressure and temperature. The heat exchanger 10 can be a gravity or pump fed heat exchanger/evaporator. The heat exchanger 10 can also be an integral part of the intermediate pressure receiver 7. This embodiment is an improvement of the twelfth embodiment since it can be adopted for systems where there is a need for cooling/refrigeration at two temperature levels. As an example the air conditioning system for hybrid or electrically driven vehicle should provide cooling for the motor and the interior compartment. The present invention can provide cooling for interior space at evaporation pressure and temperature while motor cooling is provided at intermediate pressure and temperature. The heat absorbed by the heat exchanger can also be used as additional heat source in heating mode. The reversing of the system is performed as in the first embodiment by changing the position of the two flow reversing devices 4 and 5 from heating to cooling mode and vice versa.

Fourteenth Embodiment of the Invention

Figure 29:
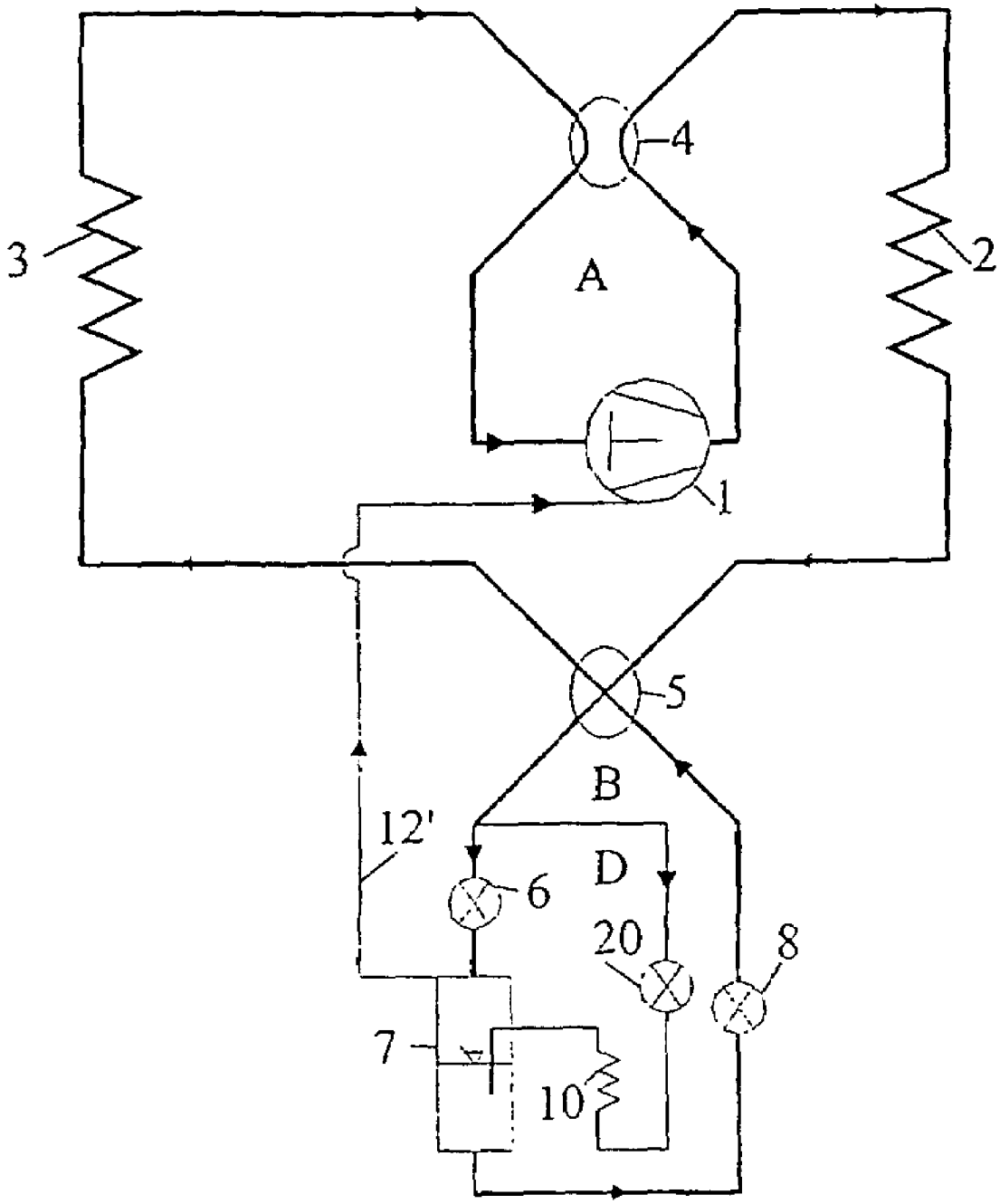
FIG. 29 is a schematic representation of a fourteenth embodiment in heating mode operation.
Figure 30:
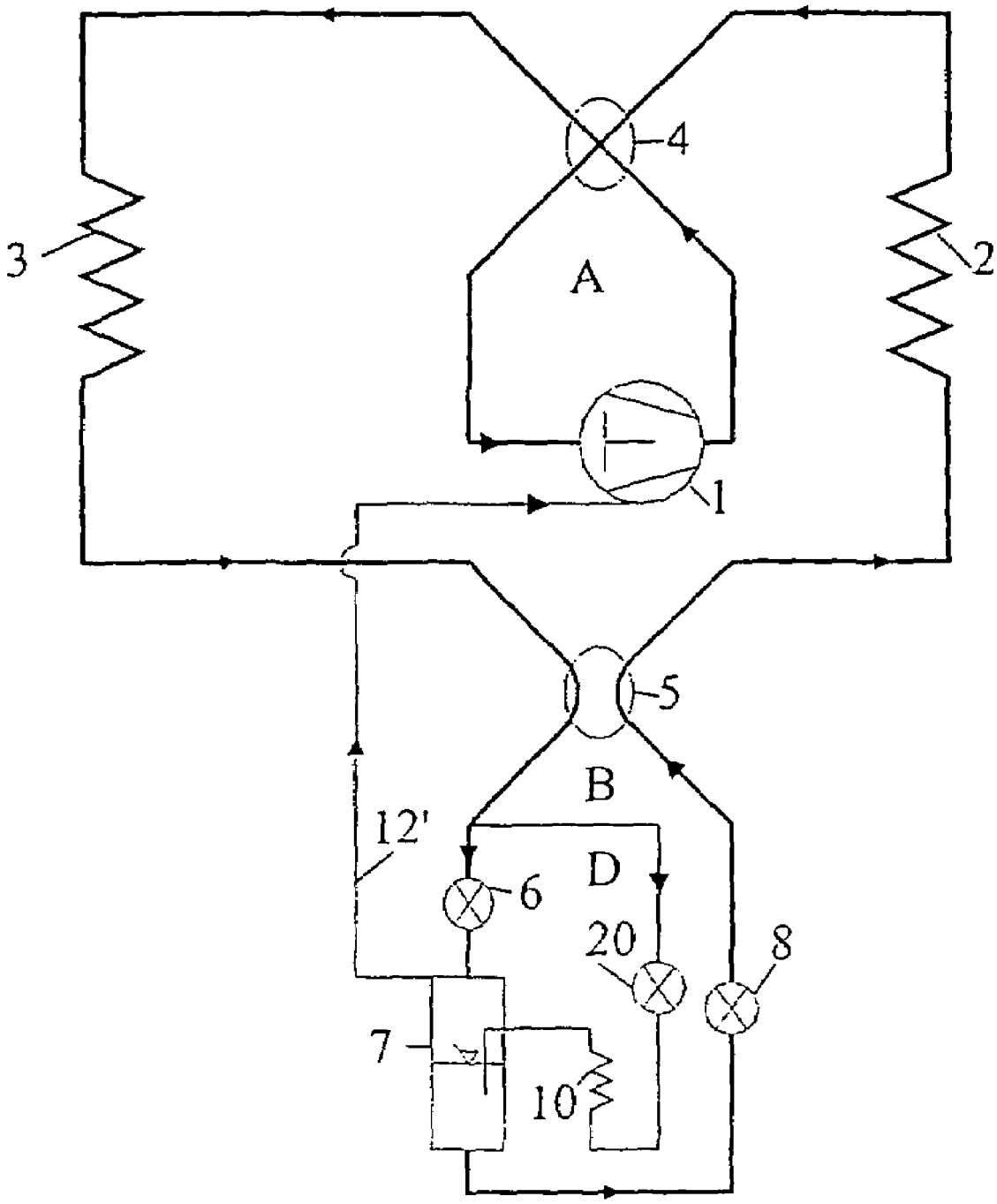
FIG. 30 is a schematic representation of the fourteenth embodiment in cooling mode operation.

The fourteenth embodiment is shown schematically in FIGS. 29 and 30 in heating and cooling mode, respectively. This embodiment is the same as the thirteenth except for arrangement of the heat exchanger 10 which is now provided in the sub-circuit D. The sub-circuit also provides an additional expansion device 20. In either heating or cooling mode, some of the high-pressure refrigerant is bleeded by the expansion device 20 where the refrigerant pressure is reduced to intermediate pressure level. The refrigerant is then evaporated by absorbing heat in the heat exchanger device before it enters the intermediate pressure receiver 7. The reversing of the system is performed as in the first embodiment by changing the position of the two flow reversing devices 4 and 5 from heating to cooling mode and vice versa.

Fifteenth Embodiment of the Invention

Figure 31:
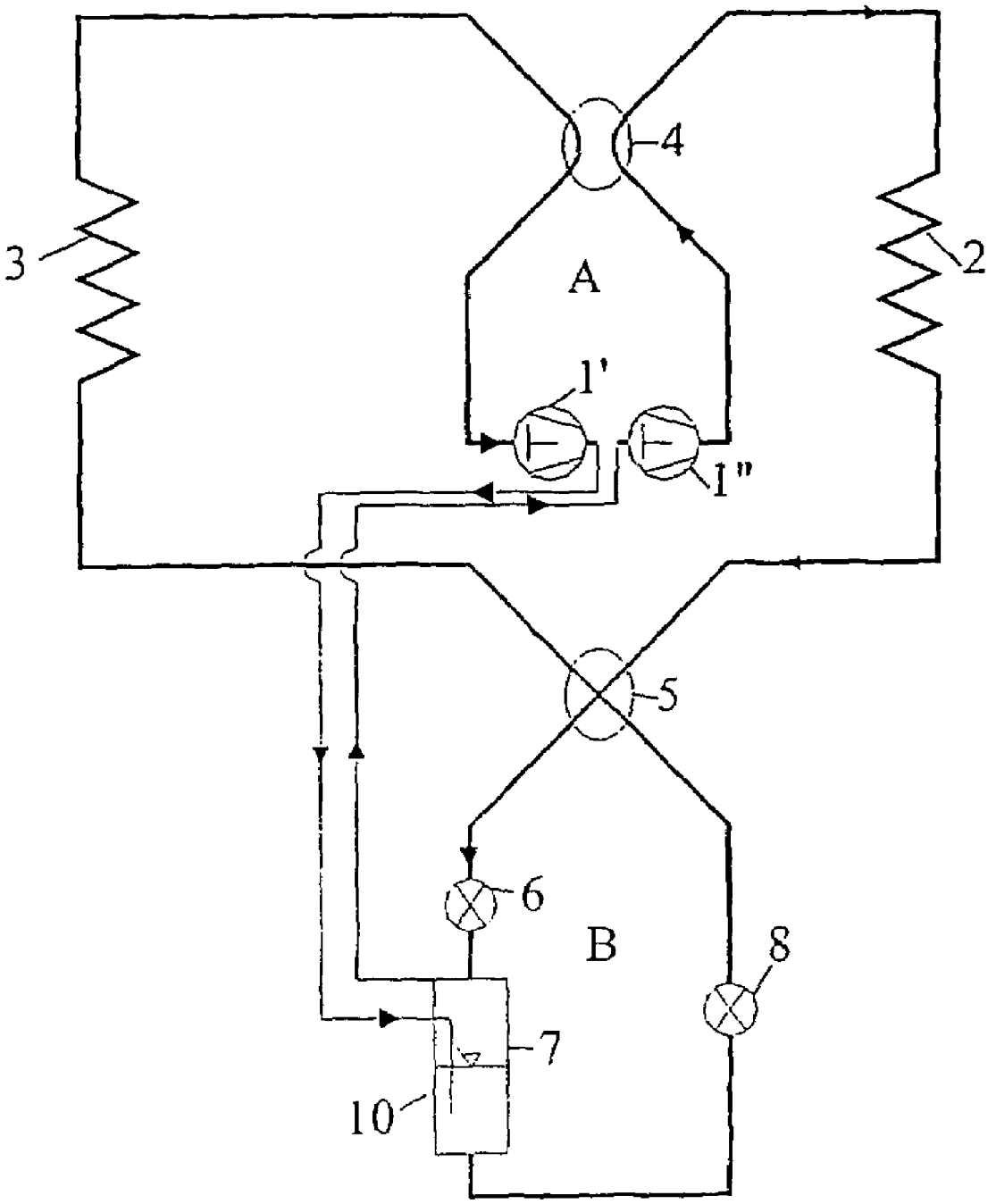
FIG. 31 is a schematic representation of a fifteenth embodiment in heating mode operation.
Figure 32:
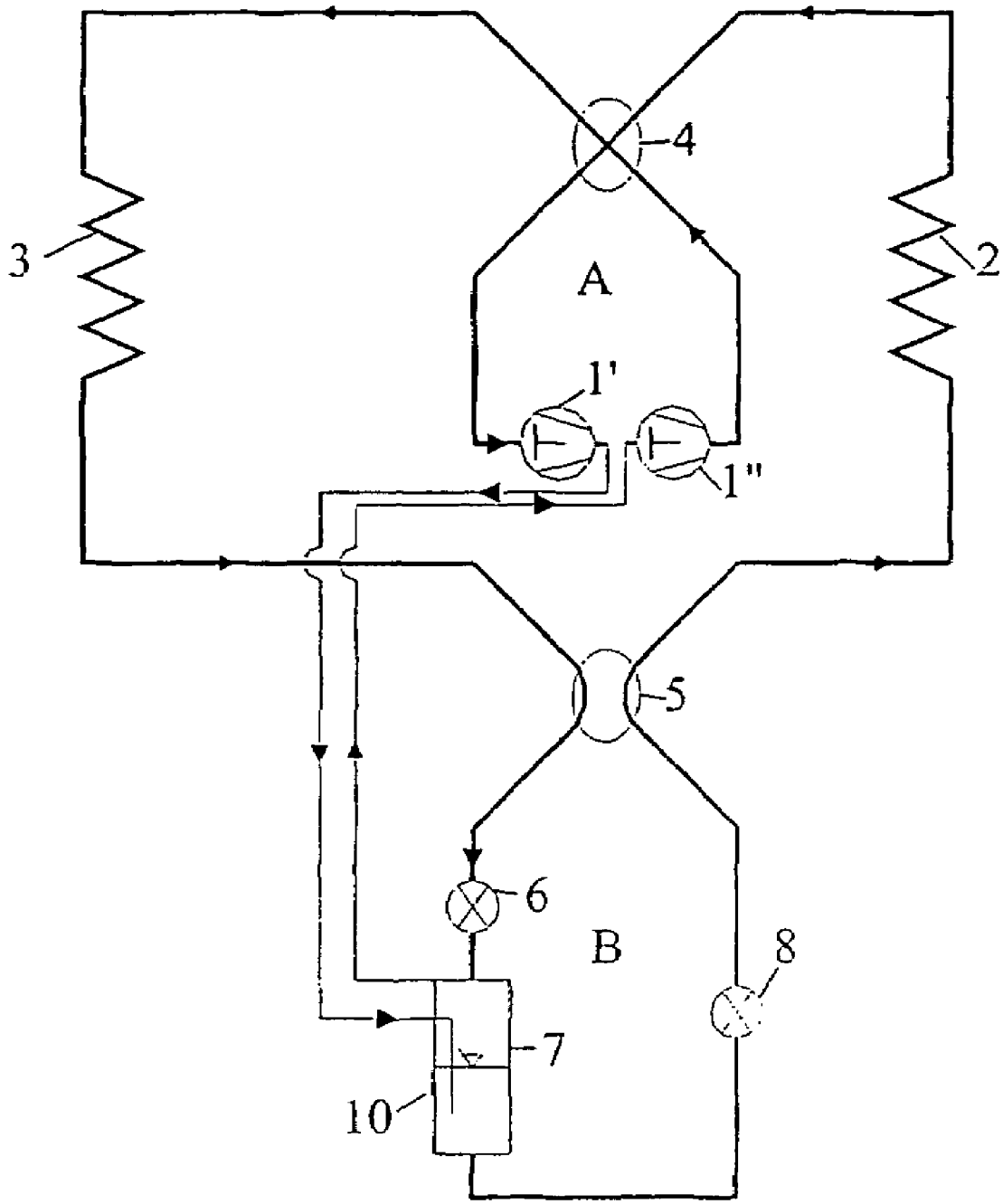
FIG. 32 is a schematic representation of the fifteenth embodiment in cooling mode operation.

The eleventh embodiment is shown schematically in FIGS. 31 and 32 in heating and cooling mode respectively.

This embodiment is characterized by two-stage compression with "inter cooling" which is achieved by discharging, through conduit 12', the hot gas from the first stage compressor 1' into the intermediate-pressure receiver/accumulator 7. By doing so, the suction gas temperature of the second stage compressor 1" will be saturated at a temperature corresponding to the saturation pressure in the intermediate-pressure receiver/accumulator 7. As a result, compared to embodiments with one-stage compression, the total work of compression will be lower and the system efficiency higher. If needed it is also possible to control the superheat of the suction gas for the second stage of the compression by directing some of the hot discharge gas from the first stage directly into the suction line of the second stage compression, i.e. bypassing the intermediate-pressure receiver/accumulator 7. The reversing of the system is performed as in the first embodiment by changing the position of the two flow reversing devices 4 and 5 from heating to cooling mode and vice versa.

Sixteenth Embodiment of the Invention

Figure 33:
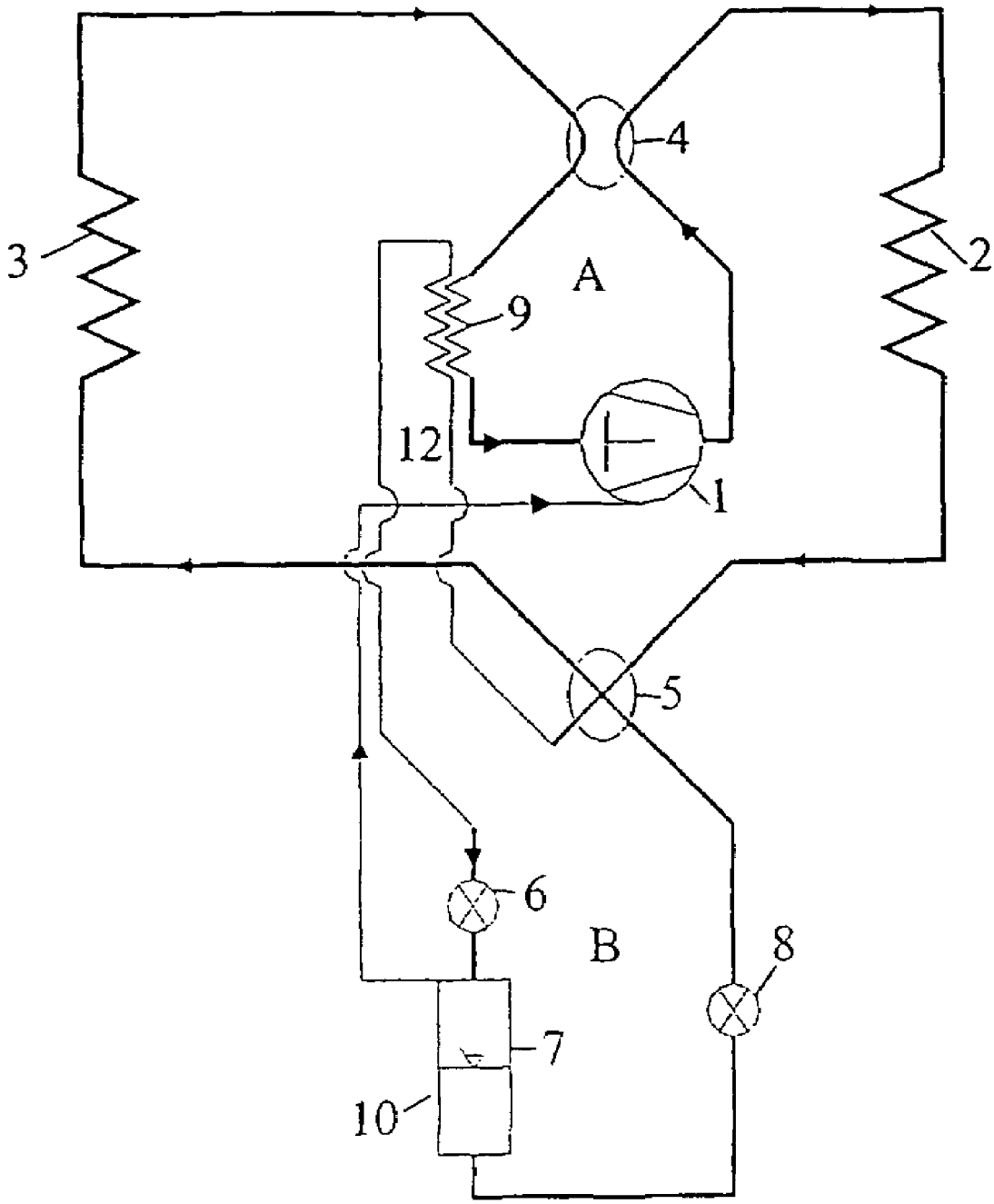
FIG. 33 is a schematic representation of a sixteenth embodiment in heating mode operation.
Figure 34:
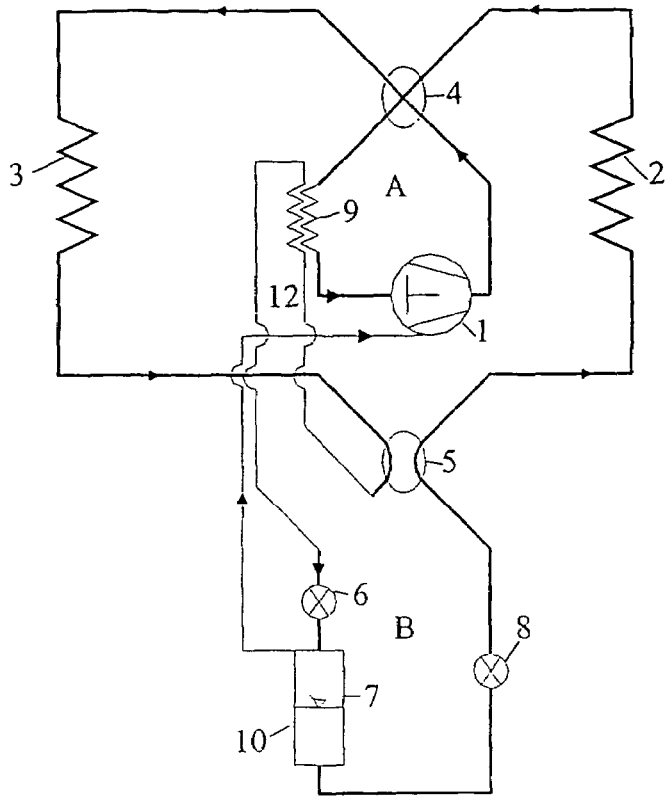
FIG. 34 is a schematic representation of the sixteenth embodiment in cooling mode operation.

FIGS. 33 and 34 show the sixteenth embodiment of a vapor compression device operating in cooling and heating mode, respectively. This embodiment represents a two-stage reversible vapor compression device, similar to the fifteenth embodiment, but has an addition of a counter-flow internal heat exchanger 9 provided in sub circuit A and exchanging heat with sub-circuit B through a conduit loop 18. The benefit of using a counter-flow internal heat exchanger 9 is to reduce the temperature of the high-pressure refrigerant before it goes through the expansion device 6, with higher refrigeration capacity and better energy efficiency as a result. The operating principle for this embodiment is as in the fifteenth embodiment except for the fact that the high pressure refrigerant after the flow reversing device 5 flows through the internal heat exchanger 9 before passing through the expansion device 6. The reversing of the system is performed as in the first embodiment by changing the position of the two flow reversing devices 4 and 5 from heating to cooling mode and vice versa.

Seventeenth Embodiment of the Invention

Figure 35:
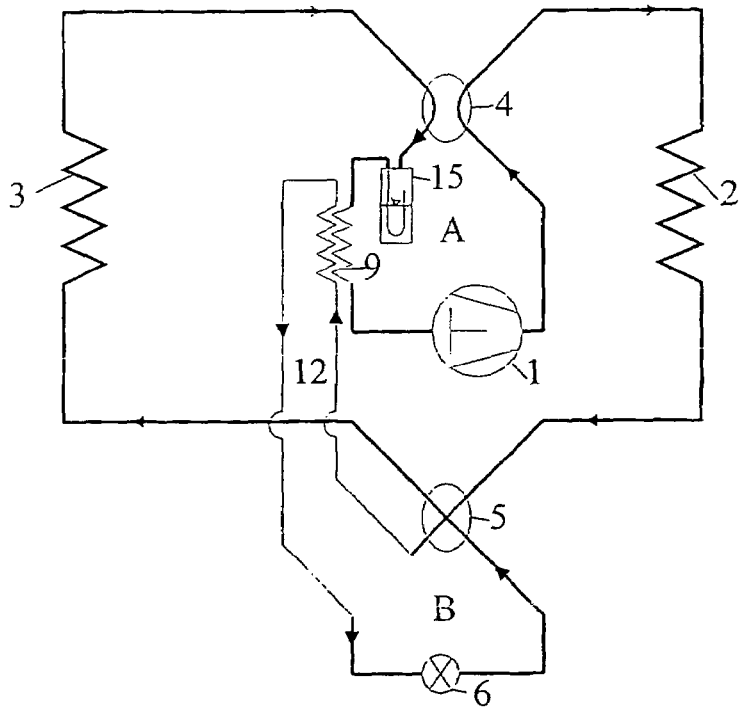
FIG. 35 is a schematic representation of a seventeenth embodiment in heating mode operation.
Figure 36:
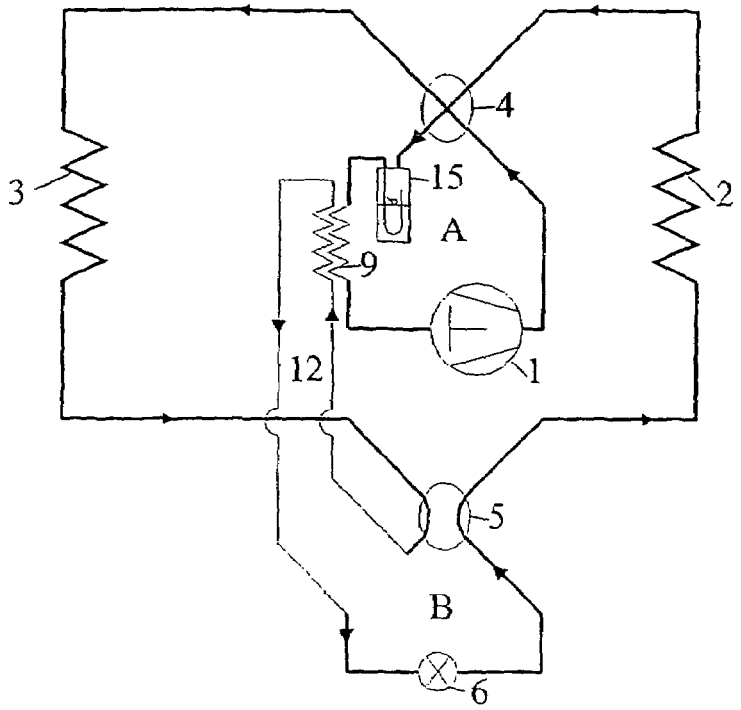
FIG. 36 is a schematic representation of the seventeenth embodiment in cooling mode operation.

This embodiment is shown schematically in FIGS. 35 and 36 in heating and cooling mode, respectively. This embodiment is the same as the sixth embodiment except for the fact that it has an additional low-pressure receiver/accumulator 15 in sub-circuit B. The reversing of the system is performed as in the first embodiment by changing the position of the two flow reversing devices 4 and 5 from heating to cooling mode and vice versa.

Eighteenth Embodiment of the Invention

Figure 37:
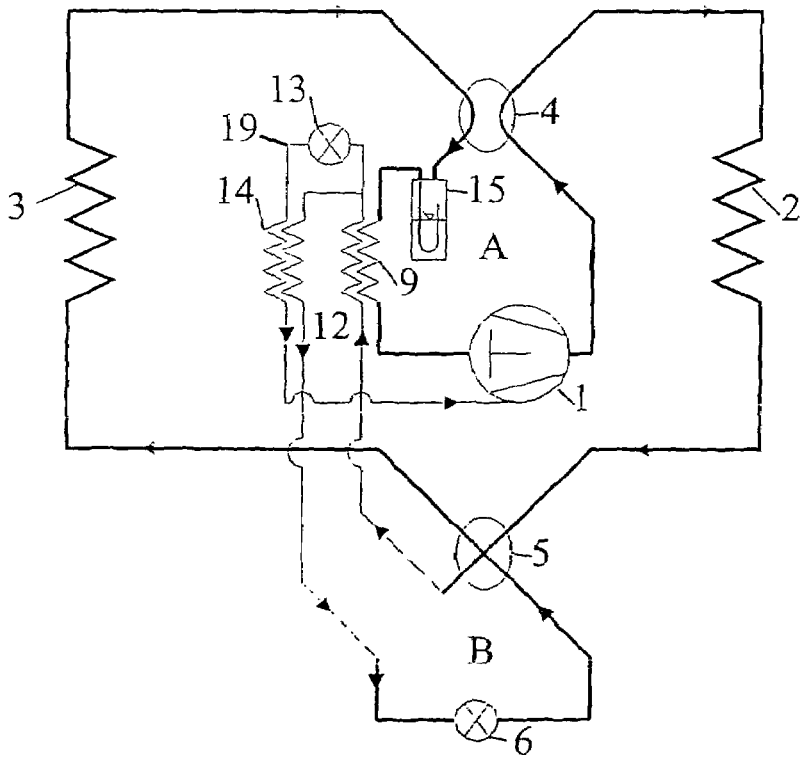
FIG. 37 is a schematic representation of an eighteenth embodiment in heating mode operation.
Figure 38:
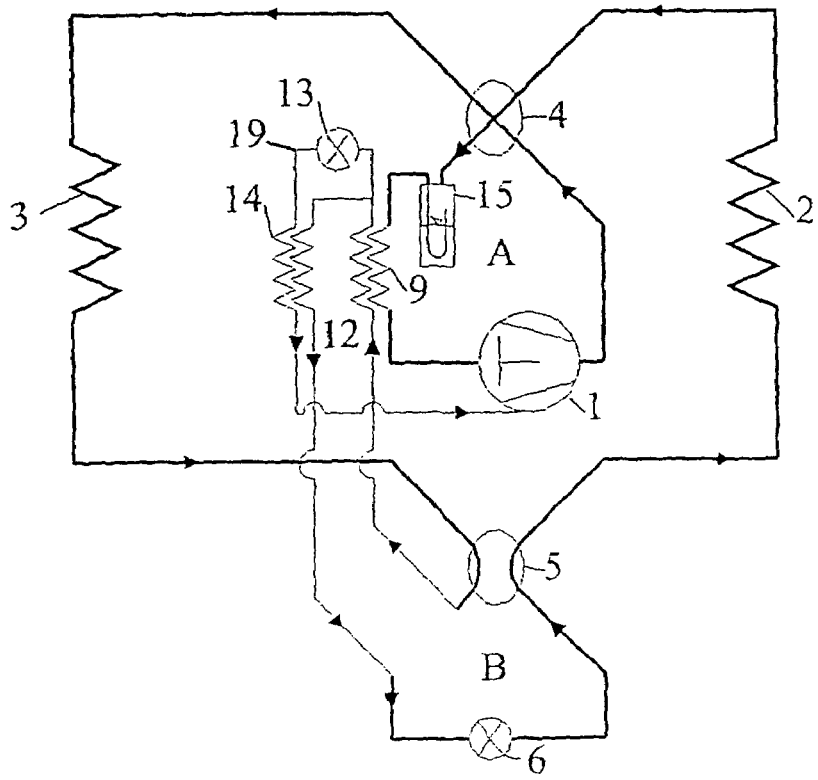
FIG. 38 is a schematic representation of the eighteenth embodiment in cooling mode operation.
Figure 39:
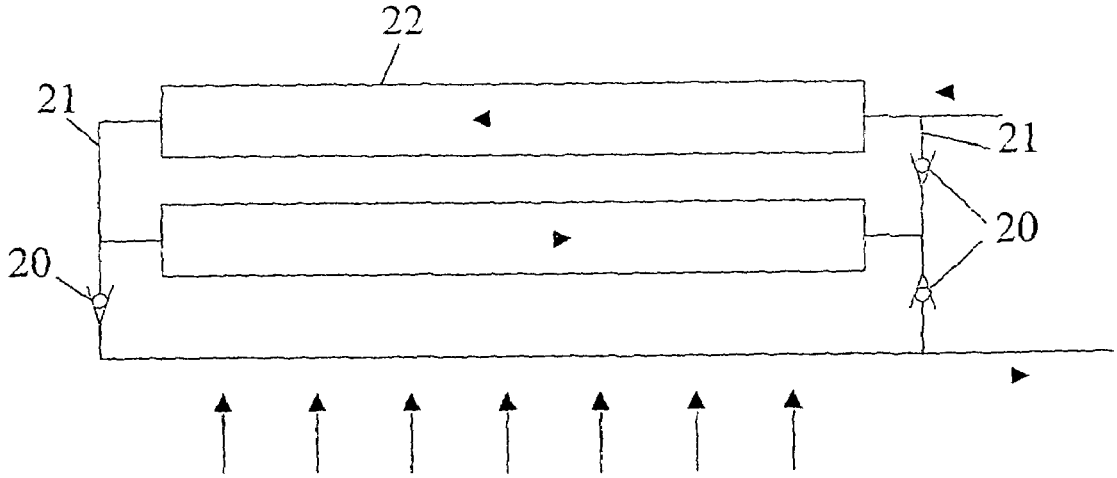
FIGS. 39–46 show schematic representations of the second aspect of the present invention.
Figure 40:
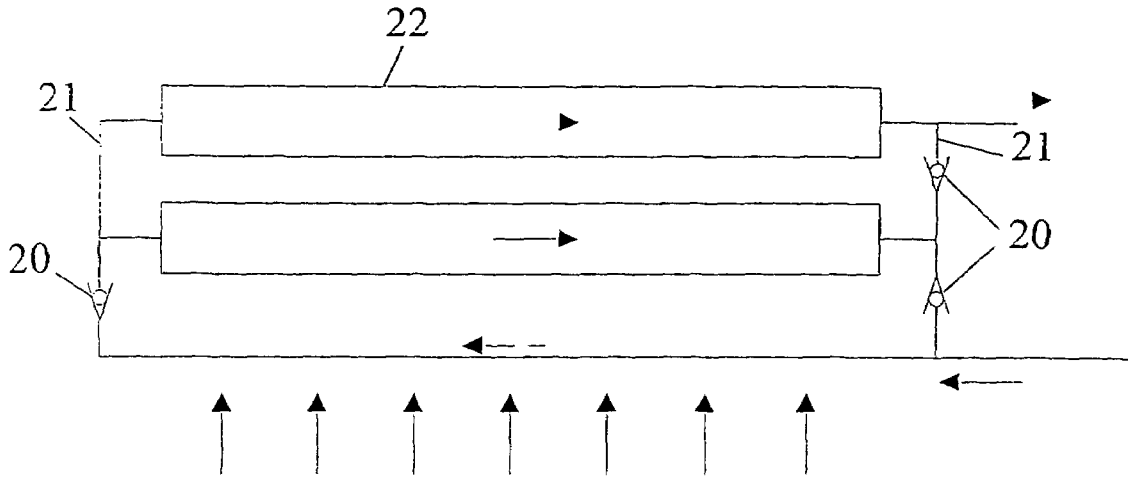
Figure 41:
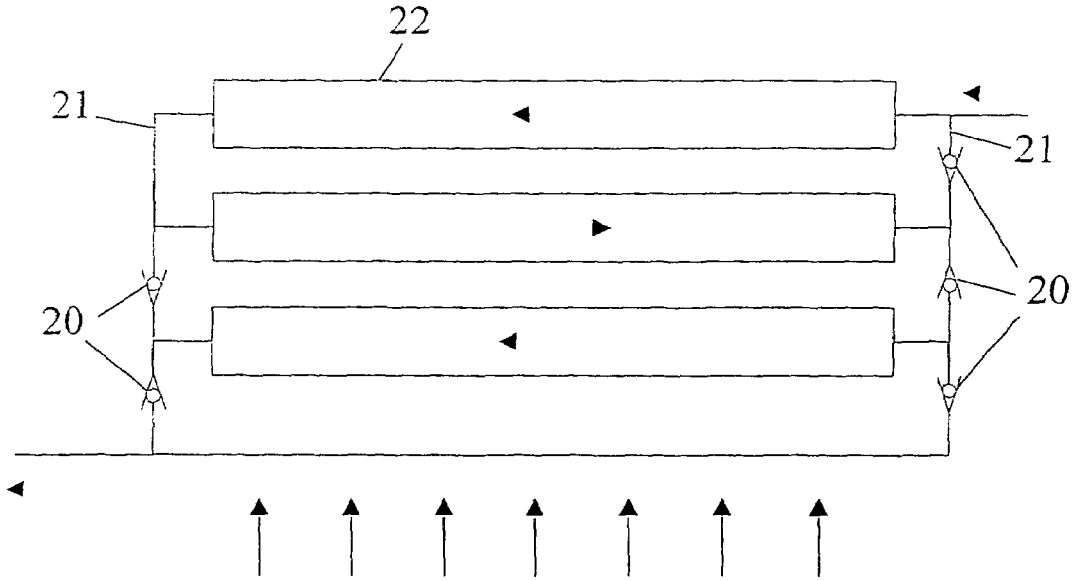
Figure 42:
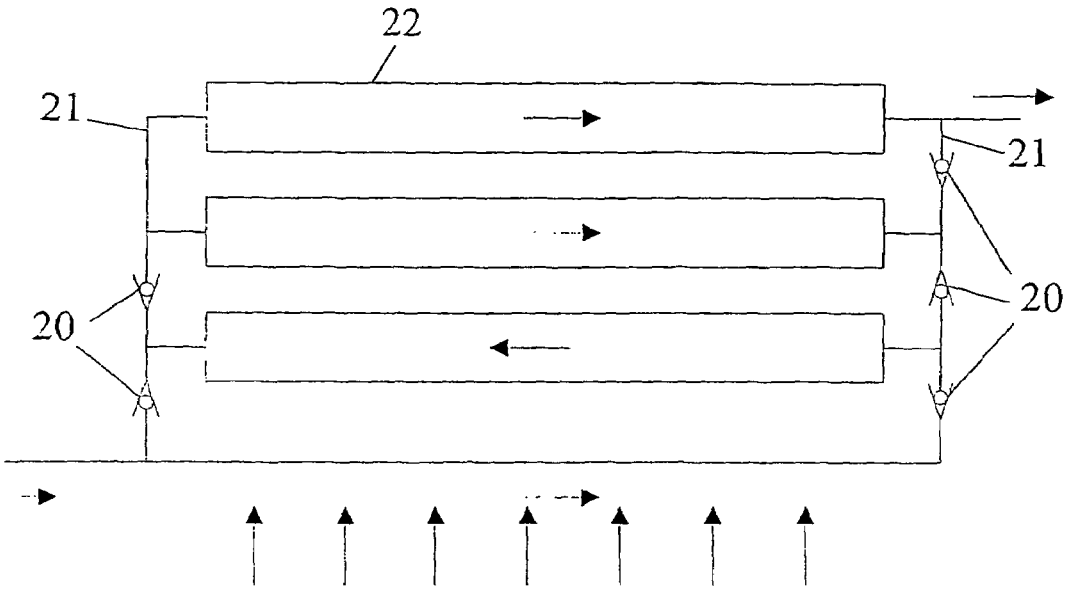
Figure 43:
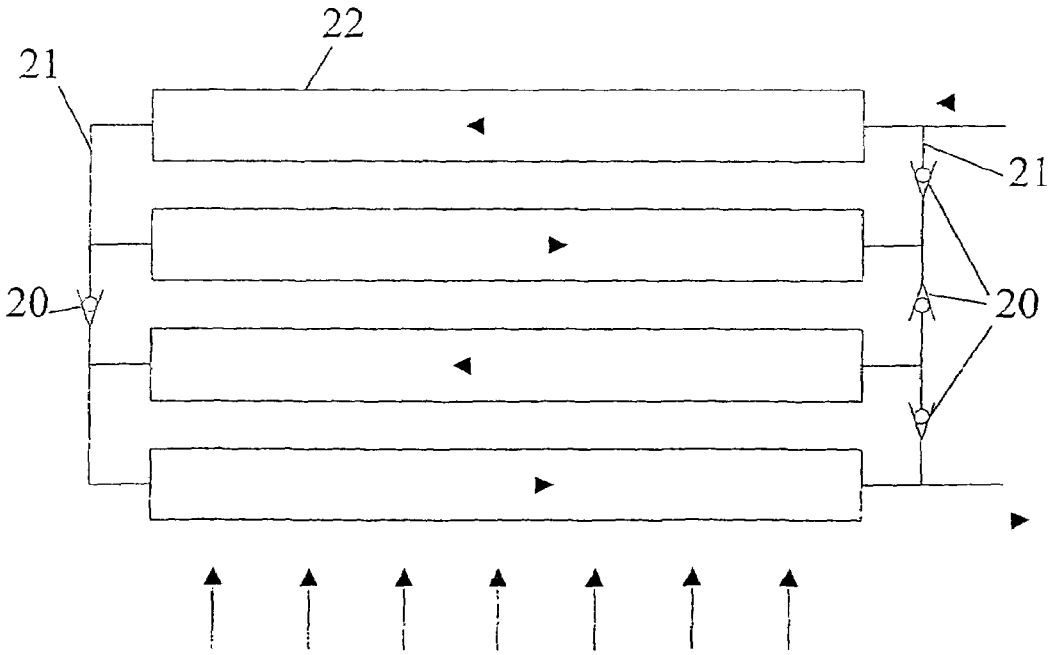
Figure 44:
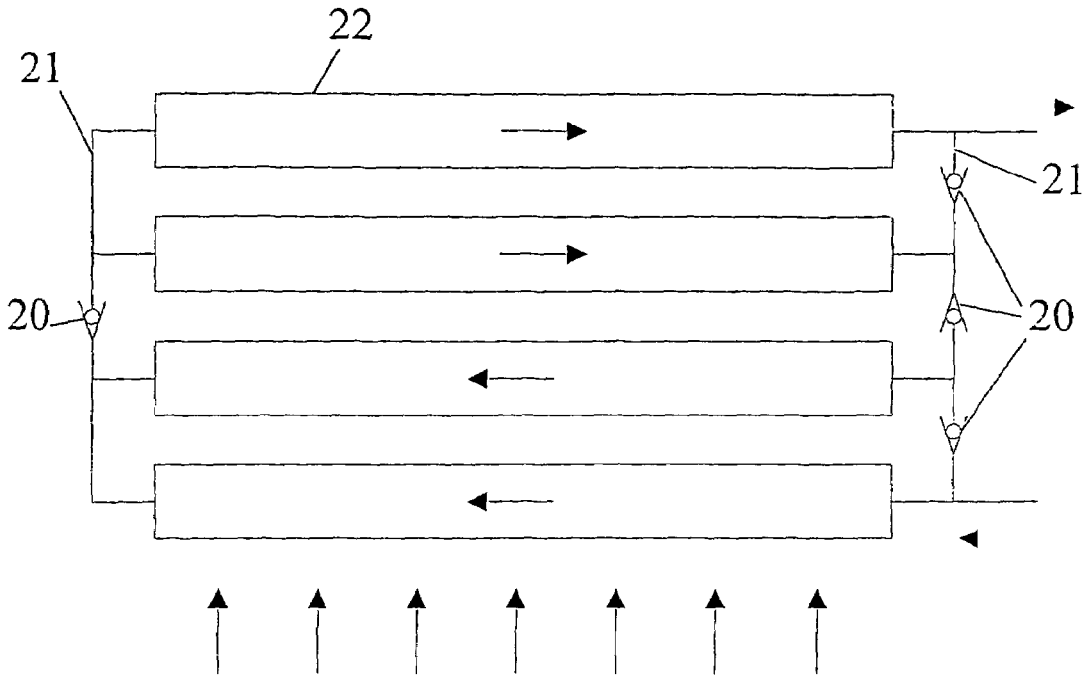
Figure 45:
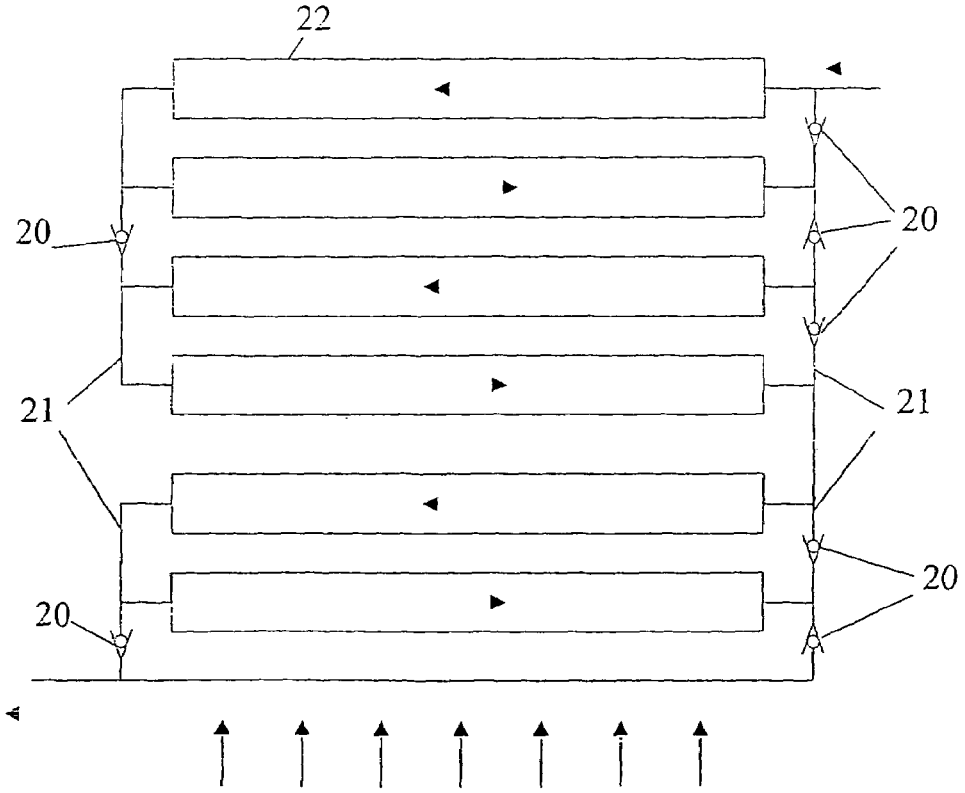
Figure 46:
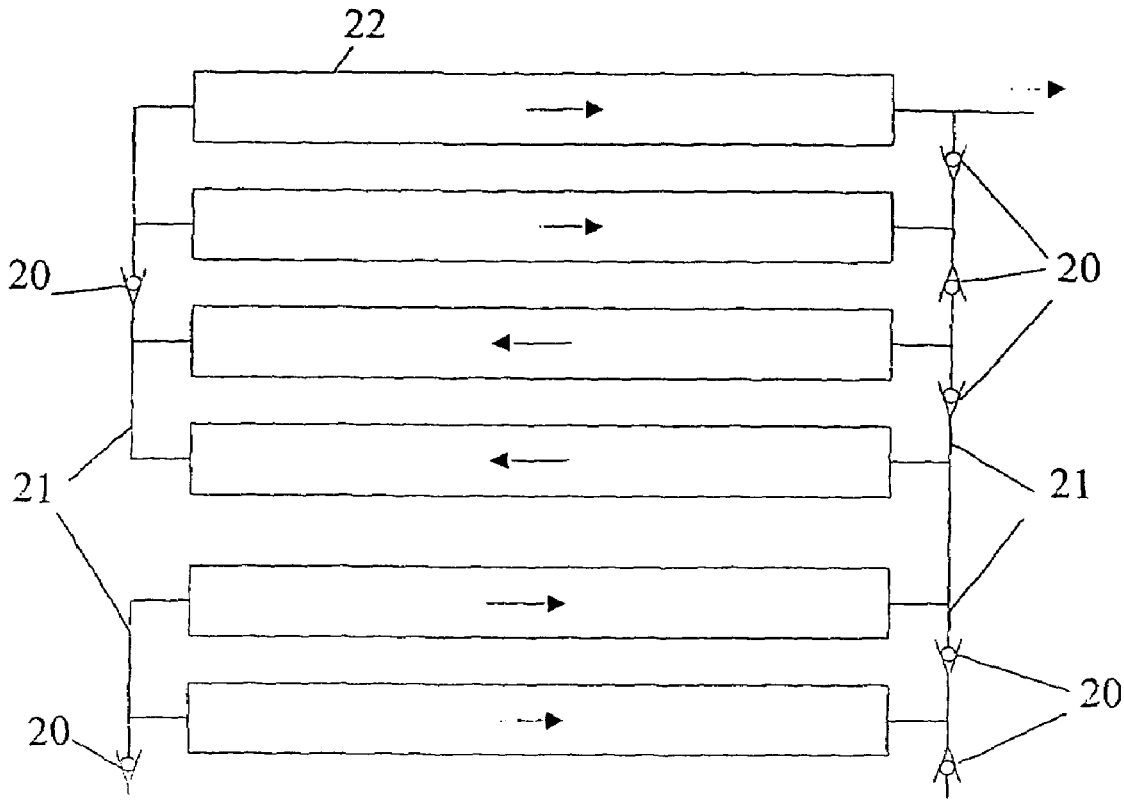

The eighteenth embodiment is shown schematically in FIG. 37 in heating mode and in FIG. 38 in cooling mode operation. According to this embodiment, the system is of a two-stage reversible vapor compression type where the compression process is carried out in two stages with "inter cooling", resulting in better vapor compression efficiency and overall system performance. This embodiment comprises in the main circuit an interior heat exchanger 2, a sub-circuit A coupled to the main circuit through a flow reversing device 4 and a sub-circuit B connected with the main circuit through a second flow reversing device 5. Sub-circuit A includes a compressor 1, a low-pressure receiver/accumulator 15 and a counter-flow internal heat exchanger 9. Sub-circuit B includes an expansion device 6. Heat is exchanged between the two sub-circuits through the internal heat exchanger 9 by passing refrigerant from sub-circuit B through the conduit 12. In addition, an inter cooler heat exchanger 14 is provided. Part of the refrigerant is led through this heat exchanger and is returned to sub-circuit B, while another part is led via another sub-conduit 19 through an expansion device 13 to the other flow path of the inter cooler heat exchanger 14 and to the second stage of the compressor 1. Compared with the thirteenth embodiment, the addition of an inter cooler heat exchanger 14 results in higher cooling capacity and lower work of compression. The compressor 1 can be a single compound unit with an intermediate suction port or two separate, first stage and second stage, compressors of any type. The reversing of the system is performed as in the first embodiment by changing the position of the two flow reversing devices 4 and 5 from heating to cooling mode and vice versa. (Second Aspect of the Invention (heat exchanger for reversible vapor compression system)A vapor compression system can be operated either in air conditioning mode, for cooling operation, or in heating mode, for heating operation. The mode of operation is changed by reversing the direction of refrigerant flow through the circuit.

During air conditioning operation, the interior heat exchanger absorbs heat by evaporation of refrigerant, while heat is rejected through the exterior heat exchanger. During heating operation, the outdoor heat exchanger acts as evaporator, while heat is rejected through the indoor heat exchanger.

Since the interior and exterior heat exchangers need to serve dual purposes, the design becomes a compromise that is not optimum for either mode. With carbon dioxide as refrigerant, the heat exchangers need to operate both as evaporator and gas cooler, with very different requirements for optimum design. During gas cooling operation, a counter flow heat exchanger type is desired, and a relatively high refrigerant mass flux is desirable. In evaporator operation, reduced mass flux is desired, and cross-flow refrigerant circuiting is acceptable.

By using appropriate means, such as check-valves, the circuiting in the heat exchanger can be changed when the mode of operation is reversed. The valves will give the heat exchanger different circuiting depending on the direction of the refrigerant flow.

FIGS. 39–46 show different heat exchangers with two, three, four and six sections, in the air flow direction, in heating and cooling mode respectively. During heating operation, as can be seen in FIGS. 38, 40, 42 and 44, the refrigerant flows sequentially through each of the four sections, in cross counter flow manner. On the other hand, by reversing the flow, the refrigerant is circulated in parallel through one and two or two and two slabs entering the air inlet side, as is shown in FIGS. 39, 41, 43 and 45. The change of flow mode is preferably obtained by means of check valves, but other valve types may be used.

The invention claimed is:

1. A reversible vapor compression system comprising:

a compressor;

an interior heat exchanger connected to the compressor;

an expansion device connected to the interior heat exchanger; and an exterior heat exchanger connected to the expansion device and to the compressor, wherein the compressor, the interior heat exchanger, the expansion device and the exterior heat exchanger are connected by means of conduits in an operable relationship to form an integral system, wherein the interior heat exchanger and the exterior heat exchanger are provided in a main circuit, whereas the compressor and the expansion device are provided in a sub-circuit A and a sub-circuit B, respectively, and the sub-circuit A is in communication with the main circuit via a first flow reversing device, and the sub-circuit B is in communication with the main circuit via a second flow reversing device, wherein the first and second flow reversing devices enable reversing of the system from a cooling mode to a heating mode and from a heating mode to a cooling mode.

2. A reversible vapor compression system according to claim 1, further comprising an additional conduit loop which provide a dehumidification heat exchanger, an expansion device and a valve, connected between said reversible device and said expansion device on the inlet side and said reversible device and compressor suction side on the outlet side.

3. A reversible vapor compression system according to claim 2, wherein the heat exchanger is connected in parallel in heating mode and in series in cooling mode using a plurality of flow changing devices.

4. A reversible vapor compression system according to claim 1, wherein the sub-circuit (B) includes three parallel branches (B1, B2, B3) being interconnected, whereby the flow reversing device is in the form of two flow diverting expansion devices connecting the outer parallel branches (B1, B3) of the sub-circuit (B) with the main integral circuit.

5. A reversible vapor compression system according to claim 4, wherein an accumulator/receiver is provided in the middle branch (B2).

6. A reversible vapor compression system according to claim 4, wherein the two flow diverting expansion devices are replaced with two flow diverting devices and one expansion device provided in the middle branch (B2).

7. A reversible vapor compression system according to claim 4, wherein a receiver/accumulator is provided in the middle branch (B2) after the expansion device.

8. A reversible vapor compression system according to claim 7, wherein an additional expansion device is provided after the receiver/accumulator.

9. A reversible vapor compression system according to claim 1, wherein the first sub-circuit (A) is provided with an additional heat exchanger after the compressor, and sub-circuit (B) is provided with an additional heat exchanger prior to the expansion device.

10. A reversible vapor compression system according to claim 1, wherein the sub-circuits, prior to the compressor in sub circuit (A) respectively prior to the expansion device in sub circuit (B) are provided with an additional internal heat exchanger.

11. A reversible vapor compression system according to claim 1, wherein sub-circuit (B) is provided with a receiver/accumulator after the expansion device, but prior to an additional expansion device.

12. A reversible vapor compression system according to claim 1, wherein the compression process takes place in two stages, whereby the flash vapor from the receiver/accumulator is drawn off via a conduit loop by the second stage of the compressor.

13. A reversible vapor compression system according to claim 12, wherein the system provides additional cooling capacity at intermediate pressure and temperature using a heat exchanger.

14. A reversible vapor compression system according to claim 13, wherein the heat exchanger is a gravity-fed or pump-fed evaporator connected to the receiver/accumulator.

15. A reversible vapor compression system according to claim 13, wherein the heat exchanger provided in a conduit loop D using another expansion device where the inlet of said conduit loop is connected between said reversing device and said expansion device and the outlet of the said conduit is connected to the receiver/accumulator.

16. A reversible vapor compression system according to claim 12, wherein the compression is performed by means of a two-stage compound compressor.

17. A reversible vapor compression system according to claim 12, wherein the compression process is a dual effect type.

18. A reversible vapor compression system according to claim 12, wherein the compressor is of a variable stroke type.

19. A reversible vapor compression system according to claim 12, wherein the compression process is performed by means of two separate, first and second stage compressors.

20. A reversible vapor compression system according to claim 12, wherein the discharge gas from the first stage compressor is led to the receiver/accumulator through a conduit loop before being drawn off from the receiver/accumulator via a conduit loop by the second stage compressor.

21. A reversible vapor compression system according to claim 12, wherein an additional internal heat exchanger is disposed in sub-circuit (A) prior to the compressor and which is provided for heat exchange between said circuit and sub-circuit (B) via a connecting conduit loop arranged prior to the expansion device.

22. A reversible vapor compression system according to claim 21, wherein an additional receiver/accumulator is provided in sub circuit (A) prior to the additional heat exchanger.

23. A reversible vapor compression system according to claim 22, wherein the compression process is performed in two stages or by dual effect compression.

24. A reversible vapor compression system according to claim 23, wherein an additional inter cooling heat exchanger is provided in the conduit loop after the internal heat exchanger, whereby part of the refrigerant from the conduit loop is bled off and passed through the low pressure side of the inter cooling heat exchanger and thereafter led to the compressor via a sub conduit loop, whereas the main part of the refrigerant is returned to the sub-circuit (B).

25. A reversible vapor compression system according to claim 1, wherein the cycle is transcritical.

26. A reversible vapor compression system according to claim 1, wherein the refrigerant is carbon dioxide.

27. A reversible vapor compression system according to claim 1,wherein defrosting of a frosted heat exchanger can be accomplished by reversing the process from heat pump to refrigeration mode.

28. The reversible vapor compression system as claimed in claim 1, wherein the flow reversing devices are integrally built into one unit performing the same function.

* * * * *